US005594406A

United States Patent [19]

Koyama et al.

[11] Patent Number: 5,594,406

[45] Date of Patent: Jan. 14, 1997

[54] ZINC OXIDE VARISTOR AND PROCESS FOR THE PRODUCTION THEREOF

[75] Inventors: Kazushige Koyama, Neyagawa; Naoki Mutoh, Kadoma; Masaaki Katsumata, Hirakata, all of Japan

[73] Assignee: Matsushita Electric Industrial Co., Ltd., Osaka, Japan

[21] Appl. No.: 122,604

[22] PCT Filed: Feb. 24, 1993

[86] PCT No.: PCT/JP93/00224

§ 371 Date: Oct. 1, 1993

§ 102(e) Date: Oct. 1, 1993

[87] PCT Pub. No.: WO93/17438

PCT Pub. Date: Sep. 2, 1993

[30] Foreign Application Priority Data

Feb. 25, 1992 [JP] Japan ..... 4-037622
Mar. 27, 1992 [JP] Japan ..... 4-070759

[51] Int. Cl.[6] ..... H01C 7/10

[52] U.S. Cl. ..... 338/21; 338/20; 29/620; 252/518

[58] Field of Search ..... 338/20, 21; 252/512, 252/518; 501/76; 428/432; 427/96; 118/406, 410; 264/61, 62; 29/620

[56] References Cited

U.S. PATENT DOCUMENTS

| | | | |
|---|---|---|---|
| 3,725,836 | 4/1973 | Wada et al. | 338/21 |
| 4,041,436 | 8/1977 | Kouchich et al. | 338/21 |
| 4,147,670 | 4/1979 | Shohata et al. | 252/519 |
| 4,319,215 | 3/1982 | Yamazaki et al. | 338/21 |
| 4,460,623 | 7/1984 | Levinson | 427/101 |
| 4,506,285 | 3/1985 | Einzinger | 357/80 |
| 4,959,262 | 9/1990 | Charles et al. | 428/329 |
| 5,091,212 | 2/1992 | Sakai et al. | 427/96 |

FOREIGN PATENT DOCUMENTS

| | | |
|---|---|---|
| 54-162199 | 12/1979 | Japan . |
| 3178101 | 8/1991 | Japan . |

*Primary Examiner*—Tu Hoang
*Attorney, Agent, or Firm*—Watson Cole Stevens Davis, P.L.L.C.

[57] ABSTRACT

A product and process of making such product in which a varistor is formed by diffusing lead borosilicate-type glass, into a surface of a fired or sintered zinc oxide substrate, i.e., "varistor element," during formation of an electrode on the surface of the substrate. Typically, an electrode paste or material, comprising a mixture or lead borosilicate-type glass frit and Ag powder, is applied to the substrate and provides the lead borosilicate-type glass for diffusing into the substrate. The improvement is that the lead borosilicate-type glass frit for the electrode paste or material comprises a mixture of PbO, $B_2O_3$, $SiO_2$ and at least one metal oxide selected from the group consisting of cobalt oxide, magnesium oxide, yttrium oxide, antimony oxide, manganese oxide, tellurium oxide, lanthanum oxide, cerium oxide, praseodium oxide, neodymium oxide, samarium oxide, europium oxide, gadolinium oxide, terbium oxide, dysprosium oxide, holmium oxide, erbium oxide, thulium oxide, ytterbium oxide and lutetium oxide.

64 Claims, 1 Drawing Sheet

ZINC OXIDE VARISTOR AND PROCESS FOR THE PRODUCTION THEREOF

TECHNICAL FIELD

The present invention relates to a zinc oxide varistor used for protecting various kinds of electronic instruments from unusually high voltages, and a process for producing the same.

BACKGROUND TECHNIQUES

Recently, there has been rapidly developed a high level integration of control circuits in instruments for general use and industry.

When an extraordinarily high voltage (surge) is applied to electronic parts of semiconductors used in such control circuits, such parts may be destroyed. Accordingly, it becomes indispensable to take a countermeasure to meet the situation. As such a counterplan, varistors are generally employed. Among the rest, the zinc oxide varistor is widely available for the protection of various kinds of electronic instruments from unusually high voltages because the zinc oxide varistor has an excellent voltage nonlinearity and surge absorbing ability.

Hithertofore, there has been widely known a zinc oxide varistor provided with at least two electrodes on the surface of varistor element having zinc oxide as its main component. Further, materials for said electrodes, are disclosed in, for example, Patent Application Kokai SHO 62-290104 Official Gazette, etc., whose content is as follows:

Electrode material for a zinc oxide varistor was produced by the process wherein 5.0% by weight of a lead borosilicate glass powder composed of 50.0–85.0% by weight of PbO, 10.0–30.0% by weight of $B_2O_3$ and 5.0–25.0% by weight of $SiO_2$ was weighed out and then said powder together with Ag powder (65.0% by weight) were milled in a vehicle (30.0% by weight), in which ethyl cellulose was dissolved in butyl carbitol, to obtain a silver paste which is the electrode material.

And then said electrode material was applied onto a surface of a fired varistor element and heated to form an electrode.

Although the above zinc oxide varistor is excellent in voltage nonlinearity as mentioned above, further improvement in the voltage nonlinearity has been sought due to the desire of energy-saving and efficiency increase in the zinc oxide varistor.

Thus, responding to the above requirements, the present invention aims to provide a zinc oxide varistor further improved in voltage nonlinearity.

DISCLOSURE OF THE INVENTION

In order to accomplish such an objective, according to the present invention, the following lead borosilicate-type glass was diffused into a fired varistor element from its surface, said lead borosilicate-type glass containing at least one metal oxide selected from cobalt oxide, magnesium oxide, yttrium oxide, antimony oxide, manganese oxide, tellurium oxide, lanthanum oxide, cerium oxide, praseodymium oxide, neodymium oxide, samarium oxide, europium oxide, gadolinium oxide, terbium oxide, dysprosium oxide, holmium oxide, erbium oxide, thulium oxide, ytterbium oxide and lutetium oxide.

When the above constitution is adopted, it follows that there is interposed at particle boundaries between zinc oxide particles composing a varistor element, the chemical elements composing a lead borosilicate-type glass containing at least one metal oxide selected from cobalt oxide, magnesium oxide, yttrium oxide, antimony oxide, manganese oxide, tellurium oxide, lanthanum oxide, cerium oxide, praseodymium oxide, neodymium oxide, samarium oxide, europium oxide, gadolinium oxide, terbium oxide, dysprosium oxide, holmium oxide, erbium oxide, thulium oxide, ytterbium oxide and lutetium oxide.

As a result, resistance values of the particle boundaries between zinc oxide particles will become higher, and a leakage current running between electrodes until reaching a varistor voltage becomes much lower. In conclusion, zinc oxide varistor improved in voltage nonlinearity can be obtained.

BEST MODES FOR CARRYING OUT THE INVENTION

Figure 1:
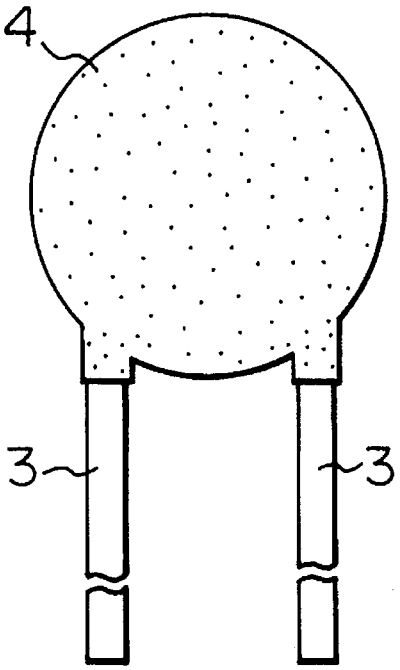
FIG. 1 is a front view showing one of the working examples of the zinc oxide varistor of the present invention.
Figure 2:
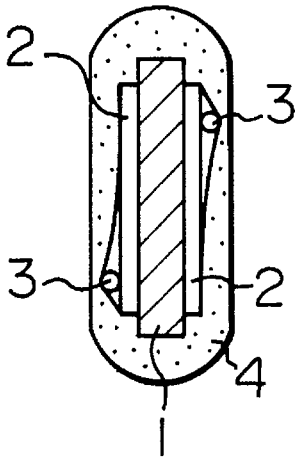
FIG. 2 is a sectional view of FIG. 1.

One of the working examples of the present invention is explained with reference to the drawings as follows:

FIG. 1 and FIG. 2 show one of the working examples of the present invention. In the drawings, 1 is a disk-shape varistor element which is 13 mm in diameter and 1.5 mm in thickness.

Figure 3:
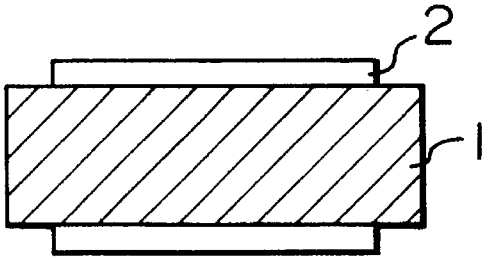
FIG. 3 is a front view showing varistor element of the zinc oxide varistor shown in FIG. 1.

On both surfaces of this varistor element 1, electrodes 2 are baked thereto as shown in FIG. 3.

The electrodes 2 are also disk-shape of 10 mm in diameter, and an outside periphery part of varistor 1 projects out and around the whole circumference of the electrodes.

In addition, upper end of lead wire 3 is fixed onto each electrode 2 by soldering.

Under said state, the outside periphery of varistor element 1 is coated with an epoxy-type insulative resin 4. As shown in FIG. 1, only the lower end of the lead wire is drawn out to the outside of the insulative resin 4.

It should be noted that the present working example is characterized by the material of electrode 2. That is, the present working example used the material formulated by milling a lead borosilicate-type glass frit into a Ag paste. This will be explained in detail hereinunder.

(Working Example 1)

At first, preparation of the glass frit will be mentioned. According to the composition table of the following Table 1, PbO, $B_2O_3$, $SiO_2$ and $Co_3O_4$ were weighed each in a given amount, and then they were simultaneously mixed and ground in a ball-mill. Thereafter, said admixture was fused in a platinum crucible at a temperature condition of 1000° C.–1500° C., and then quenched to be glassified. The obtained glass was roughly ground, which was followed by fine milling in a ball-mill to obtain a lead borosilicate-type glass frit. On the other hand, as a lead borosilicate glass frit of conventional example, a glass frit composed of 70.0% by weight of PbO, 15.0% by weight of $B_2O_3$, and 15.0% by weight of $SiO_2$ was formulated in a similar manner. The glass transition point (Tg) of each glass prepared as above was as shown in the following Table 1. Hereupon, the glass transition point (Tg) was determined by using a thermal analysis apparatus.

TABLE 1

| Designation of glass | Component ratio (wt. %) PbO | $B_2O_3$ | $SiO_2$ | $Co_3O_4$ | Tg (°C.) |
|---|---|---|---|---|---|
| A* | 70 | 15 | 15 | 0 | 405 |
| B | 69.9 | 15 | 15 | 0.1 | 405 |
| C | 60 | 15 | 15 | 10 | 420 |
| D | 45 | 15 | 15 | 25 | 465 |
| E | 40 | 15 | 15 | 30 | 475 |
| F* | 35 | 15 | 15 | 35 | 490 |
| G* | 30 | 34.9 | 35 | 0.1 | 545 |
| H | 40 | 29.9 | 30 | 0.1 | 520 |
| I | 89.9 | 5 | 5 | 0.1 | 315 |
| J* | 60 | 0 | 15 | 25 | 445 |
| K | 55 | 5 | 15 | 25 | 450 |
| L | 50 | 30 | 15 | 5 | 480 |
| M* | 40 | 40 | 15 | 5 | 500 |
| N* | 60 | 15 | 0 | 25 | 440 |
| O | 55 | 15 | 5 | 25 | 445 |
| P | 50 | 15 | 30 | 5 | 495 |
| Q* | 40 | 15 | 40 | 5 | 515 |

*are comparative examination examples which are outside of the present invention.

Then, 5.0% by weight of the lead borosilicate-type glass frit was weighed which was followed by milling in the above-mentioned Ag paste (65% by weight of Ag powder was dissolved into 30% by weight of a vehicle in which ethyl cellulose is dissolved into butyl carbitol) to produce electrode material for a zinc oxide varistor.

In order to evaluate the electrode material for zinc oxide varistor, which was produced as above, a zinc oxide varistor sintered-body (varistor element 1 in FIG. 3) (a disk-shape of 13 mm in diameter and 1.5 mm in thickness) was provided, said sintered-body consisting of bismuth oxide ($Bi_2O_3$), cobalt oxide ($Co_3O_4$), manganese oxide ($MnO_2$), nickel oxide (NiO) and titanium oxide ($TiO_2$) respectively in 0.5 mole %, and antimony oxide ($Sb_2O_3$), and chromium oxide ($Cr_2O_3$) respectively in 0.1 mole %, and 0.005 mole % of $Al_2O_3$, the rest being zinc oxide (ZnO). On both surfaces of said sintered-body, an electrode material for zinc oxide varistor was screen-printed to be 10 mm in diameter, and then baked at 800° C. for 10min. to form electrodes 2 as shown in FIG. 3. After lead wires 3 indicated in FIG. 2 were soldered thereon, the outer periphery was coated with insulating resin 4 to obtain a sample. It is noted that when the above electrode material is applied onto a surface of the sintered-body (varistor element 1) and then heated, a lead borosilicate-type glass in the electrode material, which contains cobalt oxide will penetrate into the varistor element 1, thereby exerting its effect as under-mentioned.

With respect to the thus-obtained samples, voltage ratio ($V_{1\ mA}/V_{10\ \mu A}$ representing voltage nonlinearity), surge current resistance characteristic and high temperature load life performance are shown in the following Table 2. The above voltage ratio (voltage nonlinearity) was obtained through determination using a direct current constant current electric source. Further, surge current resistance characteristic was obtained by determining a variation ratio of varistor voltage ($V_{1\ mA}$) occurring when an impact current of 8/20 μS standard waveform and 2500 A crest value was applied two times in the same direction. It is preferred that such a value is less than that in conventional example A. Further, high temperature load life performance was obtained by determining a variation ratio of varistor voltage ($V_{1\ mA}$) after 1000 hrs. when direct current voltage corresponding to 90% of sample varistor voltage was applied between lead terminals 3 at an environment temperature of 125° C. Such a value is preferably lower than that in conventional example A. The number of samples was 10 per lot.

Further, the above voltage ratio ($V_{1\ mA}/V_{10\ \mu A}$) indicates voltage nonlinearity. When the voltage ratio is less than that in conventional example A, a leakage current up to reaching a varistor voltage will become lower than conventional one. That is, $V_{1\ mA}$ represents a voltage (varistor voltage) when 1 mA current runs between electrodes 2. Likewise, $V_{10\ \mu A}$ represents a voltage when 10 μA current runs between electrodes 2. A small value of $V_{10\ \mu A}$ is not preferable because a high leakage current runs from a low voltage.

TABLE 2

| Sample No. | Designation of glass | $V_{1\ mA}/V_{10\ \mu A}$ | Surge current resistance characteristic $\Delta V_{1\ mA}$ (%) Direction same as that of current | Surge current resistance characteristic $\Delta V_{1\ mA}$ (%) Direction reverse to that of current | High temperature load life performance $\Delta V_{1\ mA}$ (%) Direction same as that of current | High temperature load life performance $\Delta V_{1\ mA}$ (%) Direction reverse to that of current |
|---|---|---|---|---|---|---|
| 1 | A* | 1.83 | −22.3 | −28.9 | −3.9 | −10.8 |
| 2 | B | 1.52 | −10.9 | −18.0 | +1.5 | −2.9 |
| 3 | C | 1.36 | −9.7 | −14.5 | +1.4 | +0.9 |
| 4 | D | 1.28 | −5.9 | −8.3 | +2.0 | +1.1 |
| 5 | E | 1.32 | −8.8 | −11.9 | +2.1 | +1.1 |
| 6 | F* | 1.71 | −16.7 | −21.7 | +1.2 | −1.7 |
| 7 | G* | 1.51 | −16.2 | −23.5 | +1.3 | −2.4 |
| 8 | H | 1.46 | −12.8 | −17.3 | +2.2 | +0.3 |
| 9 | I* | 1.38 | −25.5 | −36.9 | −10.5 | −20.8 |
| 10 | J* | 1.30 | −20.4 | −26.0 | +0.8 | −2.8 |
| 11 | K | 1.32 | −10.2 | −16.4 | +1.7 | +0.1 |
| 12 | L | 1.39 | −11.5 | −19.1 | +1.8 | +0.2 |
| 13 | M* | 1.36 | −18.4 | −26.3 | +1.9 | −0.2 |

TABLE 2-continued

| Sample No. | Designation of glass | $V_{1\ mA}/V_{10\ \mu A}$ | Surge current resistance characteristic $\Delta V_{1\ mA}$ (%) | | High temperature load life performance $\Delta V_{1\ mA}$ (%) | |
|---|---|---|---|---|---|---|
| | | | Direction same as that of current | Direction reverse to that of current | Direction same as that of current | Direction reverse to that of current |
| 14 | N* | 1.32 | −21.0 | −27.8 | +1.1 | −3.7 |
| 15 | O | 1.34 | −11.3 | −17.2 | +1.8 | +0.4 |
| 16 | P | 1.36 | −10.1 | −18.2 | +1.0 | +0.2 |
| 17 | Q* | 1.45 | −20.5 | −28.4 | +0.9 | +0.1 |

*are comparative examination examples which are outside of the present invention.

At first, there is contemplated from Tables 1 and 2 the influence on voltage ratio (voltage nonlinearity), surge current resistance characteristic and high temperature load life performance by $Co_3O_4$ content contained in a lead borosilicate-type glass frit in an electrode material for a zinc oxide varistor. As compared with the lead borosilicate glass of the conventional example containing no $Co_3O_4$ (Designation of glass: A in Table 1), the composition systems having $Co_3O_4$ content of 0.1% by weight or more are improved in voltage ratio (voltage nonlinearity) but those having $Co_3O_4$ content of more than 30.0% by weight or more will deteriorate voltage nonlinearity and surge current resistance characteristic. Accordingly, it is a necessary condition that lead borosilicate glass in an electrode material for zinc oxide varistor is a composition system containing at least 0.1–30.0% by weight of $Co_3O_4$.

On the other hand, since surge current resistance characteristic and high temperature load life performance are affected by contents of PbO, $B_2O_3$ and $SiO_2$ in addition to $Co_3O_4$ content, these compositions are required to be considered. Therefore, influence on surge current resistance characteristic and high temperature load life performance by constitution components of lead borosilicate-type glass contained in an electrode material for a zinc oxide varistor will be considered on the basis of Tables 1 and 2. Glass of a composition system having PbO content less than 40.0% by weight has a higher glass transition point (Tg in Table 1) and too small a fluidity of the glass, which results in a deteriotated solder-wetness of the glass. Contrarily, glass of a composition system having PbO content of more than 80.0% by weight has a lower glass transition point and too high a fluidity of the glass, which results in a lower adhesion strength of electrode 2 onto varistor element 1, this fact leads to a lack of reliability. In a composition system having $B_2O_3$ content of less than 5.0% by weight, surge current resistance characteristic becomes inferior. On the other hand, in a composition system having $B_2O_3$ content of more than 30.0% by weight, surge current resistance characteristic is also deteriorated. In a composition system having $SiO_2$ content of less than 5.0% by weight, surge current resistance characteristic is also lowered. In a composition system having $SiO_2$ content of more than 30.0% by weight, surge current resistance characteristic will also become lowered.

From the above results, it is understandable that a composition of glass components of an electrode material for a zinc oxide varistor is optimum in a range of 40.0–80.0% by weight of PbO, 5.0–30.0% by weight of $B_2O_3$, 5.0–30.0% by weight of $SiO_2$ and 0.1–30.0% by weight of $Co_3O_4$.

Although lead oxide, boron oxide, silicon oxide and cobalt oxide were used, as material of lead borosilicate-type glass, in the forms of PbO, $B_2O3$, $SiO_2$ and $Co_3O_4$, respectively in the present working example, it was confirmed that similar characteristics could also have been obtained by using the other oxide forms. Further, the present working example referred only to the case in which lead borosilicate-type glass content in electrode material for a zinc oxide varistor was 5.0% by weight. However, so far as said content is within 1.0–30.0% by weight, no change is seen in the effect of the present invention. Furthermore, the zinc oxide varistor of system consisting of ZnO, $Bi_2O_3$, $Co_3O_4$, $MnO_2$, NiO, $TiO_2$, $Sb_2O_3$, $Cr_2O_3$ and $Al_2O_3$ was used as a sintered varistor element 1 for evaluation. However, even when the electrode material for a zinc oxide varistor according to the present invention is applied to a zinc oxide varistor containing $Pr_6O_{11}$, CaO, BaO, MgO, $K_2O$, $SiO_2$, etc., no change is seen in effect.

(Working Example 2)

Hereinunder, detailed explanation is made for the second working example of the present invention.

At first, the description refers to formulation of glass frit to be incorporated to electrode material for zinc oxide varistor. According to the composition list of the following Table 3, PbO, $B_2O_3$, $SiO_2$ and MgO weighed each in a given amount were mixed and simultaneously ground in a ball mill, and then fused under a temperature condition of 1000° C.–1500° C. in a Pt-crucible, which was followed by quenched to be glassified. The thus-obtained glass was roughly crushed and then finely milled in a ball mill to obtain lead borosilicate-type glass frit. Also, glass powder composed of 70.0% by weight of PbO, 15.0% by weight of $B_2O_3$ and 15.0% by weight of $SiO_2$ was prepared by a similar procedure, as a conventional example of lead borosilicate glass. The glass transition point (Tg) of the thus-obtained glass is shown in the following Table 3. Herein, the glass transition point (Tg) was determined using a thermal analysis apparatus.

TABLE 3

| Designation of glass | Component ratio (wt. %) PbO | $B_2O_3$ | $SiO_2$ | MgO | Tg (°C.) |
|---|---|---|---|---|---|
| A* | 70 | 15 | 15 | 0 | 405 |
| B | 69.9 | 15 | 15 | 0.1 | 405 |
| C | 60 | 15 | 15 | 10 | 420 |
| D | 50 | 15 | 15 | 20 | 410 |
| E | 40 | 15 | 15 | 30 | 420 |
| F* | 40 | 10 | 10 | 40 | 410 |
| G* | 30 | 34.9 | 35 | 0.1 | 545 |
| H | 40 | 29.9 | 30 | 0.1 | 520 |
| I* | 89.9 | 5 | 5 | 0.1 | 315 |

TABLE 3-continued

| Designation of glass | Component ratio (wt. %) PbO | $B_2O_3$ | $SiO_2$ | MgO | Tg (°C.) |
|---|---|---|---|---|---|
| J* | 65 | 0 | 15 | 20 | 390 |
| K | 60 | 5 | 15 | 20 | 395 |
| L | 50 | 30 | 15 | 5 | 470 |
| M* | 40 | 40 | 15 | 5 | 490 |
| N* | 65 | 15 | 0 | 20 | 410 |
| O | 60 | 15 | 5 | 20 | 415 |
| P | 50 | 15 | 30 | 5 | 490 |
| Q* | 40 | 15 | 40 | 5 | 510 |

*are comparative examination examples which are outside of the present invention.

Then, the lead borosilicate-type glass frit was weighed by 5.0% by weight, which was followed by milling in the above-mentioned Ag paste (65% by weight of Ag powder was dissolved into 30% by weight of a vehicle, in which ethyl cellulose is dissolved into butyl carbitol) to produce electrode material for a zinc oxide varistor.

In order to evaluate the electrode material for a zinc oxide varistor, which was produced as above, a zinc oxide varistor sintered-body (varistor element 1) (a disk-shape of 13 mm in diameter and 1.5 mm in thickness) was provided, said sintered-body consisting of bismuth oxide ($Bi_2O_3$), cobalt oxide ($Co_3O_4$), manganese oxide (MnO2), nickel oxide (NiO) and titanium oxide ($TiO_2$) respectively in 0.5 mole %, and antimony oxide ($Sb_2O_3$) and chromium oxide ($Cr_2O_3$) respectively in 0.1 mole %, and 0.005 mole % of $Al_2O_3$, the rest being zinc oxide (ZnO). On both surfaces of said sintered-body, an electrode material for zinc oxide varistor was screen-printed to be 10 mm in diameter, and then baked at 800° C. for 10 min. to form electrodes 2 and then lead wires 3 were soldered thereon, and thereafter the outer periphery was molded with insulative resin 4 to obtain a sample.

With respect to the thus-obtained samples, voltage ratio ($V_{1\ mA}/V_{10\ \mu A}$) and limit voltage ratio and surge current resistance characteristic are shown in the following Table 4. Herein, the voltage ratio and limit voltage ratio were obtained through determination using a direct current constant current electric source. Further, the surge current resistance characteristic was obtained by determining a variation ratio of varistor voltage ($V_{1\ mA}$) occurring when an impact current of 8/20 μS standard waveform and 2500 A crest value applied two times in the same direction. The number of samples was 10 per lot.

TABLE 4

| Sample No. | Designation of glass | $V_{1\ mA}/V_{10\ \mu A}$ | Limit voltage ratio $V_{5\ A}/V_{1\ mA}$ | Surge current resistance characteristic $\Delta V_{1\ mA}$ (%) Direction same as that of current | Direction reverse to that of current |
|---|---|---|---|---|---|
| 1 | A* | 1.83 | 1.93 | −22.3 | −28.9 |
| 2 | B | 1.50 | 1.77 | −11.2 | −18.3 |
| 3 | C | 1.32 | 1.66 | −9.6 | −15.4 |
| 4 | D | 1.24 | 1.51 | −5.3 | −7.8 |
| 5 | E | 1.35 | 1.71 | −7.4 | −11.7 |
| 6 | F* | 1.56 | 1.85 | −16.6 | −21.8 |
| 7 | G* | 1.51 | 1.76 | −17.8 | −24.1 |
| 8 | H | 1.45 | 1.74 | −11.4 | −18.4 |
| 9 | I | 1.39 | 1.88 | −26.4 | −33.8 |
| 10 | J* | 1.31 | 1.59 | −20.7 | −25.1 |
| 11 | K | 1.30 | 1.56 | −10.3 | −15.8 |
| 12 | L | 1.37 | 1.66 | −11.4 | −18.7 |
| 13 | M* | 1.39 | 1.68 | −19.6 | −26.8 |
| 14 | N* | 1.28 | 1.59 | −17.1 | −25.8 |
| 15 | O | 1.31 | 1.58 | −11.0 | −16.4 |
| 16 | P | 1.38 | 1.65 | −10.8 | −17.9 |
| 17 | Q* | 1.43 | 1.66 | −21.4 | −29.7 |

*are comparative examination examples which are outside of the present invention.

At first, there is contemplated from Tables 3 and 4, the influence on voltage ratio (voltage nonlinearity), limit voltage ratio characteristic and surge current resistance characteristic by MgO content contained in a lead borosilicate-type glass frit in an electrode material for a zinc oxide varistor. As compared with the lead borosilicate glass of the conventional example containing no MgO, the composition systems having MgO content of 0.1% by weight or more are improved in voltage ratio (voltage nonlinearity) but those having MgO content of more than 30.0% by weight will deteriorate in limit voltage characteristic and surge current resistance characteristic. Accordingly, it is a necessary condition that a lead borosilicate-type glass in an electrode material for a zinc oxide varistor is a composition system containing at least 0.1–30.0% by weight of MgO.

On the other hand, since the limit voltage ratio characteristic ($V_{5\ A}/V_{1\ mA}$) and surge current resistance characteristic are affected by contents of PbO, $B_2O_3$ and $SiO_2$ in addition to MgO content, these compositions are required to be considered. Therefore, influence on limit voltage ratio characteristic and surge current resistance characteristic by constitution components of lead borosilicate glass contained in an electrode material for zinc oxide varistor will be considered on the basis of Tables 3 and 4. Glass of a composition system having PbO content of less than 40.0% by weight has a higher glass transition point and too little a fluidity of glass, which result in a lower solder-wetness of glass. Contrarily, glass of a composition system having PbO content of more than 80.0% by weight has a lower glass transition point and too great a fluidity of glass, which results in a lower adhesion strength of an electrode. Therefore, this fact leads to lack of reliability. In a composition system having $B_2O_3$ content of less than 5.0% by weight, surge current resistance characteristic becomes inferior. On the other hand, in a composition system having $B_2O_3$ content of more than 30.0% by weight, surge current resistance characteristic is also deteriorated. In a composition system having $SiO_2$ content of less than 5.0% by weight, surge current resistance characteristic is also deteriorated. In a composition system having $SiO_2$ content of more than 30.0% by weight, surge current resistance characteristic will also become deteriorated.

From the above results, it is understandable that composition of glass components of electrode material for zinc oxide varistor is optimum to be in a range of 40.0–80.0% by weight of PbO, 5.0–30.0% by weight of $B_2O_3$, 5.0–30.0% by weight of $SiO_2$ and 0.1–30.0% by weight of MgO.

Although lead oxide, boron oxide, silicon oxide and magnesium oxide were used, as materials of lead borosilicate-type glass, in the forms of PbO, $B_2O_3$, $SiO_2$ and MgO, respectively in the present working example, it was confirmed that the similar characteristics could have also been obtained by using the other oxide forms. Further, the present working example referred only to the case in which the lead borosilicate-type glass content in electrode material for zinc oxide varistor was 5.0% by weight. However, so far as said content is within 1.0–30.0% by weight, no change is seen in the effect of the present invention. Furthermore, the zinc oxide varistor of a system consisting of ZnO, $Bi_2O_3$, $Co_3O_4$, $MnO_2$, NiO, $TiO_2$, $Sb_2O_3$, $Cr_2O_3$ and $Al_2O_3$ was used as a sintered-body for evaluation. However, even when the electrode material for the zinc oxide varistor according to the present invention is applied to a zinc oxide varistor containing $Pr_6O_{11}$, CaO, BaO, MgO, $K_2O$, $SiO_2$, etc., no change is seen in effect.

(Working Example 3)

Hereinunder, detailed explanation is made for the third working example of the present invention.

At first, the description refers to formulation of glass frit to be incorporated to electrode material for zinc oxide varistor. According to the composition list of the following Table 5, PbO, $B_2O_3$, $SiO_2$ and $MnO_2$ each weighed in a given amount were mixed and simultaneously ground in a ball mill, and then fused under a temperature condition of 1000° C.–1500° C. in a Pt-crucible, which was followed by quenching to be glassified. The thus-obtained glass was roughly crushed and then finely milled in a ball mill to obtain lead borosilicate-type glass frit. Also, glass powder composed of 70.0% by weight of PbO, 15.0% by weight of $B_2O_3$ and 15.0% by weight of $SiO_2$ was prepared by a similar procedure, as a conventional example of lead borosilicate glass. The glass transition point (Tg) of the thus-obtained glass is shown in the following Table 5. Herein, the glass transition point (Tg) was determined using a thermal analysis apparatus.

Then, the lead borosilicate-type glass powder was weighed in a given amount (5.0% by weight), which was followed by milling in the above-mentioned Ag paste (65% by weight of Ag powder was dissolved into 30% by weight of a vehicle in which ethyl cellulose was dissolved into butyl carbitol) to produce an electrode material for zinc oxide varistor.

In order to evaluate the electrode material for zinc oxide varistor, which was produced as above, a zinc oxide varistor sintered-body (varistor element 1) (a disk-shape being 13 mm in diameter and 1.5 mm in thickness) was provided, said sintered-body consisting of bismuth oxide ($Bi_2O_3$), cobalt oxide ($Co_3O_4$), manganese oxide ($MnO_2$), nickel oxide (NiO), antimony oxide ($Sb_2O_3$), and chromium oxide ($Cr_2O_3$) respectively in 0.5 mole %, and 0.005 mole % of $Al_{2O3}$, the rest being zinc oxide (ZnO). On both surfaces of said sintered-body, an electrode material for zinc oxide varistor was applied to be 10 mm in diameter, and then baked at 800° C. for 10 min. to form electrodes 2. Then, lead wires 3 were soldered thereon, and thereafter, molded with insulating resin 4 to obtain a sample.

With respect to the thus-obtained samples, voltage ratio ($V_{1\ mA}/V_{10\ \mu A}$), surge current resistance characteristic and high temperature load life performance are shown in the following Table 6. Herein, the above voltage ratio (voltage nonlinearity) was obtained through determination using a direct current constant current electric source. Further, surge current resistance characteristic was obtained by determining a variation ratio of varistor voltage ($V_{1\ mA}$) occurring when an impact current of 8/20 μS standard waveform and 5000 A crest value was applied two times in the same direction. Further, high temperature load life performance was obtained by determining a variation ratio of varistor voltage ($V_{1\ mA}$) after 1000 hrs. under the conditions of 125° C. of environment temperature and 90% of applied voltage ratio. The number of samples was 10 per lot.

TABLE 5

| Designation of glass | Component ratio (wt. %) PbO | $B_2O_3$ | $SiO_2$ | $MnO_2$ | Tg (°C.) |
|---|---|---|---|---|---|
| A* | 70 | 15 | 15 | 0 | 405 |
| B | 69.9 | 15 | 15 | 0.1 | 405 |
| C | 60 | 15 | 15 | 10 | 430 |
| D | 45 | 15 | 15 | 25 | 480 |
| E | 40 | 15 | 15 | 30 | 495 |
| F* | 35 | 15 | 15 | 35 | 530 |
| G* | 30 | 34.9 | 35 | 0.1 | 545 |
| H | 40 | 29.9 | 30 | 0.1 | 520 |
| I* | 89.9 | 5 | 5 | 0.1 | 315 |
| J* | 60 | 0 | 15 | 25 | 460 |
| K | 55 | 5 | 15 | 25 | 465 |
| L | 50 | 30 | 15 | 5 | 480 |
| M* | 40 | 40 | 15 | 5 | 495 |
| N* | 60 | 15 | 0 | 25 | 455 |
| O | 55 | 15 | 5 | 25 | 465 |
| P | 50 | 15 | 30 | 5 | 515 |
| Q* | 40 | 15 | 40 | 5 | 525 |

*are comparative examination examples which are outside of the present invention.

TABLE 6

| Sample No. | Designation of glass | $V_{1\ mA}/V_{10\ \mu A}$ | Surge current resistance characteristic $\Delta V_{1\ mA}$ (%) | | High temperature load life performance $\Delta V_{1\ mA}$ (%) | |
|---|---|---|---|---|---|---|
| | | | Direction same as that of current | Direction reverse to that of current | Direction same as that of current | Direction reverse to that of current |
| 1 | A* | 1.33 | −18.4 | −27.5 | −3.9 | −8.8 |
| 2 | B | 1.13 | −14.5 | −25.3 | +1.3 | −3.1 |
| 3 | C | 1.06 | −9.4 | −15.5 | +1.4 | +0.5 |
| 4 | D | 1.09 | −4.3 | −7.3 | +2.0 | +1.6 |
| 5 | E | 1.12 | −12.3 | −15.9 | +2.2 | +1.8 |
| 6 | F* | 1.24 | −20.5 | −24.7 | +1.2 | −2.7 |
| 7 | G* | 1.10 | −22.4 | −28.3 | +1.1 | −2.8 |
| 8 | H | 1.12 | −15.9 | −26.4 | +1.0 | +0.3 |
| 9 | I* | 1.34 | −38.6 | −49.7 | −5.5 | −9.8 |
| 10 | J* | 1.25 | −20.4 | −26.0 | −1.8 | −3.8 |
| 11 | K | 1.17 | −9.2 | −16.1 | +1.0 | +0.2 |
| 12 | L | 1.10 | −10.5 | −19.2 | +1.8 | −0.1 |
| 13 | M* | 1.13 | −22.3 | −38.7 | +1.7 | −1.2 |
| 14 | N* | 1.12 | −21.0 | −27.9 | +1.3 | −3.7 |
| 15 | O | 1.13 | −10.3 | −17.1 | +1.5 | +0.6 |
| 16 | P | 1.15 | −9.8 | −18.2 | +2.0 | +0.7 |
| 17 | Q* | 1.16 | −22.5 | −33.4 | +1.9 | +0.3 |

*are comparative examination examples which are outside of the present invention.

At first, there is contemplated from Tables 5 and 6 the influence on voltage nonlinearity by $MnO_2$ content contained in a lead borosilicate-type glass in an electrode material for a zinc oxide varistor. The composition systems having $MnO_2$ content of 0.1% by weight or more are improved in voltage nonlinearity.

Those in which $MnO_2$ content is more than 30.0% by weight take a bad turn in voltage ratio (voltage nonlinearity) as well as surge current resistance characteristic. Accordingly, it is a necessary condition that lead borosilicate-type glass in an electrode material for zinc oxide varistor is a composition system containing at least 0.1–30.0% by weight of $MnO_2$.

On the other hand, since surge current resistance characteristic and high temperature load life performance are affected by contents of PbO, $B_2O_3$ and $SiO_2$ in addition to $Co_3O_4$ content, these compositions are required to be considered.

Next, influence on surge current resistance characteristic and high temperature load life performance by constituents of lead borosilicate-type glass contained in an electrode material for zinc oxide varistor will be considered referring to Tables 5 and 6. Glass of a composition system having PbO content less than 40.0% by weight has a higher glass transition point Tg and too low a fluidity of glass, which result in a deteriorated solder-wetness of glass. Contrarily, glass of a composition system having PbO content of more than 80.0% by weight has a lower glass transition point and too high a fluidity of glass, which result in a lower adhesion strength of electrode, and therefore, lacks reliability. In a composition system having $B_2O_3$ content of less than 5.0% by weight, high temperature load life performance becomes inferior. On the other hand, in a composition system having $B_2O_3$ content of more than 30.0% by weight, surge current resistance characteristic is also deteriorated. In a composition system having $SiO_2$ content of less than 5.0% by weight, surge current resistance characteristic is also deteriorated. In a composition system having $SiO_2$ content of more than 30.0% by weight, surge current resistance characteristic will also become deteriorated.

From the above results, it is understandable that composition of glass components of electrode material for zinc oxide varistor is optimum to be in a range of 40.0–80.0% by weight of PbO, 5.0–30.0% by weight of $B_2O_3$, 5.0–30.0% by weight of $SiO_2$ and 0.1–30.0% by weight of $MnO_2$.

Although lead oxide boron oxide, silicon oxide and manganese oxide were used, as material of lead borosilicate-type glass, in the forms of PbO, $B_2O_3$, $SiO_2$ and $Co_3O_4$, respectively in the present working example, it was confirmed that the similar characteristics could have also been obtained by using the other oxide forms. Further, the present working example referred only to the case in which lead borosilicate-type glass content in electrode material for zinc oxide varistor was 5.0% by weight. However, so far as said content is within 1.0–30.0% by weight, no change is seen in the effect of the present invention. Furthermore, the zinc oxide varistor of a system consisting of ZnO, $Bi_2O_3$, $Co_3O_4$, $MnO_2$, NiO, $Sb_2O_3$, $Cr_2O_3$ and $Al_2O_3$ was used as a sintered-body (varistor element 1) for evaluation. However, even when the electrode materials for a zinc oxide varistor according to the present invention are applied to a zinc oxide varistor containing $Pr_6O_{11}$, CaO, BaO, MgO, $K_2O$, $SiO_2$, etc., no change is seen in effect.

(Working Example 4)

Hereinunder, detailed explanation is made for the 4th working example of the present invention.

At first, the description refers to the formulation of glass frit to be incorporated in the electrode material for zinc oxide varistor. According to the composition list of the following Table 7, PbO, $B_2O_3$, $SiO_2$ and $Sb_2O_3$ weighed each in a given amount were mixed and simultaneously ground in a ball mill, and then fused under a temperature condition of 1000° C.–1500° C. in a Pt-crucible, which was followed by quenching to be glassified. The thus-obtained glass was roughly crushed and then finely milled in a ball mill to obtain lead borosilicate-type glass frit. Also, glass powder composed of 70.0% by weight of PbO, 15.0% by weight of $B_2O_3$ and 15.0% by weight of $SiO_2$ was prepared in the similar procedure, as a conventional example of lead borosilicate glass. Glass transition point (Tg) the thus-obtained glass was shown in the following Table 7. Herein, glass transition point (Tg) was determined using a thermal analysis apparatus.

Then, the lead borosilicate-type glass frit was weighed by 5.0% by weight, which was followed by milling in the above-mentioned Ag paste (65% by weight of Ag powder was dissolved into 30% by weight of a vehicle in which ethyl cellulose is dissolved into butyl carbitol) to produce electrode material for a zinc oxide varistor.

In order to evaluate the electrode material for zinc oxide varistor, which was produced as above, a zinc oxide varistor sintered-body (varistor element 1) (a disk-shape being 13 mm in diameter and 1.5 mm in thickness) was provided, said sintered-body consisting of bismuth oxide ($Bi_2O_3$), cobalt oxide ($Co_3O_4$), manganese oxide ($MnO_2$), nickel oxide (NiO), antimony oxide ($Sb_2O_3$) and chromium oxide ($Cr_2O_3$) respectively in 0.5 mole %, and 0.005 mole % of $Al_2O_3$, the rest being zinc oxide (ZnO). On both surfaces of said sintered-body, an electrode material for zinc oxide varistor was screen-printed to be 10 mm in diameter, and then baked at 800° C. for 10 min. to form electrodes 2. After lead wires 3 were soldered thereon, the outer periphery was molded with insulating resin 4 to obtain a sample.

With respect to the thus-obtained samples, voltage ratio ($V_{1\ mA}/V_{10\ \mu A}$), limit voltage ratio ($V_{25\ A}/V_{1\ mA}$) and surge current resistance characteristics are shown in the following Table 8. The voltage ratio and limit voltage ratio were obtained through determination using a direct current constant current electric source. Further, surge current resistance characteristic was obtained by determining a variation ratio of varistor voltage ($V_{1\ mA}$) occurring when an impact current of 8/20 μS standard waveform and 5000 A crest value was applied two times in the same direction. The number of samples was 10 per lot.

TABLE 7

| Designation of glass | Component ratio (wt. %) PbO | $B_2O_3$ | $SiO_2$ | $Sb_2O_3$ | Tg (°C.) |
|---|---|---|---|---|---|
| A* | 70 | 15 | 15 | 0 | 405 |
| B | 69.9 | 15 | 15 | 0.1 | 405 |
| C | 60 | 15 | 15 | 10 | 435 |
| D | 45 | 15 | 15 | 25 | 470 |
| E | 40 | 15 | 15 | 30 | 480 |
| F* | 35 | 15 | 15 | 35 | 510 |
| G* | 30 | 34.9 | 35 | 0.1 | 545 |
| H | 40 | 29.9 | 30 | 0.1 | 520 |
| I* | 89.9 | 5 | 5 | 0.1 | 315 |
| J* | 60 | 0 | 15 | 25 | 450 |
| K | 55 | 5 | 15 | 25 | 465 |

TABLE 7-continued

| Designation of glass | Component ratio (wt. %) PbO | $B_2O_3$ | $SiO_2$ | $Sb_2O_3$ | Tg (°C.) |
|---|---|---|---|---|---|
| L | 50 | 30 | 15 | 5 | 490 |
| M* | 40 | 40 | 15 | 5 | 515 |
| N* | 60 | 15 | 0 | 25 | 445 |
| O | 55 | 15 | 5 | 25 | 455 |
| P | 50 | 15 | 30 | 5 | 520 |
| Q* | 40 | 15 | 40 | 5 | 535 |

*are comparative examination examples which are outside of the present invention.

TABLE 8

| Sample No. | Designation of glass | $V_{1\ mA}/V_{10\ \mu A}$ | Limit voltage ratio $V_{25\ A}/V_{1\ mA}$ | Surge current resistance characteristic $\Delta V_{1\ mA}$ (%) Direction same as that of current | Direction reverse to that of current |
|---|---|---|---|---|---|
| 1 | A* | 1.33 | 1.57 | −18.4 | −27.5 |
| 2 | B | 1.16 | 1.42 | −17.5 | −25.3 |
| 3 | C | 1.09 | 1.40 | −8.4 | −14.9 |
| 4 | D | 1.07 | 1.35 | −6.3 | −9.8 |
| 5 | E | 1.13 | 1.34 | −4.6 | −7.7 |
| 6 | F* | 1.28 | 1.36 | −21.7 | −26.4 |
| 7 | G* | 1.10 | 1.53 | −22.5 | −28.1 |
| 8 | H | 1.12 | 1.46 | −10.4 | −25.3 |
| 9 | I* | 1.34 | 1.51 | −38.9 | −49.5 |
| 10 | J* | 1.22 | 1.55 | −20.7 | −25.1 |
| 11 | K | 1.15 | 1.40 | −10.3 | −16.8 |
| 12 | L | 1.10 | 1.43 | −10.4 | −18.7 |
| 13 | M* | 1.10 | 1.50 | −22.4 | −27.7 |
| 14 | N* | 1.08 | 1.49 | −24.1 | −27.8 |
| 15 | O | 1.11 | 1.45 | −9.5 | −16.1 |
| 16 | P | 1.15 | 1.43 | −9.8 | −15.9 |
| 17 | Q* | 1.14 | 1.48 | −21.4 | −29.7 |

*are comparative examination examples which are outside of the present invention.

At first, there is contemplated from Tables 7 and 8 the influence on voltage ratio (voltage nonlinearity), limit voltage ratio characteristic and surge current resistance characteristic by an $Sb_2O_3$ content contained in a lead borosilicate-type glass frit in an electrode material for a zinc oxide varistor. As compared with the lead borosilicate glass of the conventional example containing no $Sb_2O_3$, the composition systems having an $Sb_2O_3$ content of 0.1% by weight or more are improved in voltage ratio (voltage nonlinearity) but those having an $Sb_2O_3$ content of more than 30.0% by weight will deteriorate in surge current resistance characteristic. Accordingly, it is a necessary condition that lead borosilicate-type glass in an electrode material for zinc oxide varistor is a composition system containing at least 0.1–30.0% by weight of $Sb_{2O3}$.

On the other hand, since limit voltage ratio characteristic ($V_{25\ A}/V_{1\ mA}$) and surge current resistance characteristic are affected by contents of PbO, $B_2O_3$, and $SiO_2$ in addition to $Sb_2O_3$ content, these compositions are required to be considered. Therefore, influence on limit voltage ratio characteristic and surge current resistance characteristic and high temperature load life performance by constituents of lead borosilicate-type glass contained in an electrode material for zinc oxide varistor will be considered referring to Tables 7 and 8. Glass of a composition system having PbO content less than 40.0% by weight has a higher glass transition point (Tg) and too little a fluidity of glass, which result in a deteriorated solder-wetness of glass. Contrarily, glass of a composition system having a PbO content of more than 80.0% by weight has a lower glass transition point Tg and too high a fluidity of glass, which result in a lower adhesion strength of an electrode. This lacks reliability. In a composition system having a $B_2O_3$, content of less than 5.0% by weight, surge current resistance characteristic becomes greatly inferior. On the other hand, in a composition system having a $B_2O_3$, content exceeding 30.0% by weight, surge current resistance characteristic is also deteriorated. In a composition system having a $SiO_2$ content of less than 5.0% by weight, surge current resistance characteristic is also deteriorated. In a composition system having $SiO_2$ content exceeding 30.0% by weight, surge current resistance characteristic will also become deteriorated.

From the above results, it is understandable that composition of glass components of electrode material for zinc oxide varistor is optimum to be in a range of 40.0–80.0% by weight of PbO, 5.0–30.0% by weight of $B_2O_3$, 5.0–30.0% by weight of $SiO_2$ and 0.1–30.0% by weight of $Sb_2O_3$.

Although lead oxide, boron oxide, silicon oxide and antimony oxide were used, as material of lead borosilicate-type glass, in the forms of PbO, $B_2O_3$, $SiO_2$ and $Sb_2O_3$, respectively in the present working example, it was confirmed that the similar characteristics could have also been obtained by using the other oxide forms. Further, the present working example referred only to the case in which lead borosilicate-type glass content in electrode material for a zinc oxide varistor was 5.0% by weight. However, so far as said content is within 1.0–30.0% by weight, no change is seen in the effect of the present invention. Furthermore, a zinc oxide varistor of a system consisting of ZnO, $Bi_2O_3$, $Co_3O_4$, $MnO_2$, NiO, $Sb_2O_3$, $Cr_2O_3$ and $Al_2O_3$ was used as a sintered-body for evaluation. However, even when the electrode material for zinc oxide varistor according to the present invention is applied to a zinc oxide varistor containing $Pr_6O_{11}$, CaO, BaO, $Sb_2O_3$, $K_2O$, $SiO_2$, etc., no change is seen in effect.

(Working Example 5)

Hereinunder, detailed explanation is made for the 5th working example of the present invention.

At first, the description refers to the formulation of glass frit to be incorporated to electrode material for a zinc oxide varistor. According to the composition list of the following Table 9, PbO, $B_2O_3$, $SiO_2$ and $Y_2O_3$ each weighed in a given amount were mixed and simultaneously ground in a ball mill, and then fused under a temperature condition of 1000° C.–1500° C. in a Pt-crucible, which was followed by quenching to be glassified. The thus-obtained glass was roughly crushed and then finely milled in a ball mill to obtain lead borosilicate-type glass frit. Also, glass powder composed of 70.0% by weight of PbO, 15.0% by weight of $B_2O_3$, and 15.0% by weight of $SiO_2$ was prepared by a similar procedure, as a conventional example of lead borosilicate glass. A glass transition point (Tg) of the thus-obtained glass is shown in the following Table 9. Herein, glass transition point (Tg) was determined using a thermal analysis apparatus.

Then, 5.0% by weight of the lead borosilicate-type glass frit was weighed, which was followed by milling in the above-mentioned Ag paste (65% by weight of Ag powder was dissolved into 30% by weight of a vehicle in which ethyl cellulose is dissolved into butyl carbitol) to produce electrode material for a zinc oxide varistor.

In order to evaluate the electrode material for zinc oxide varistor, which was produced as above, a zinc oxide varistor sintered-body (varistor element 1) (a disk-shape being 13 mm in diameter and 1.5 mm in thickness) was provided, said sintered-body consisting of bismuth oxide ($Bi_2O_3$), cobalt oxide ($Co_3O_4$), manganese oxide ($MnO_2$), nickel oxide (NiO), antimony oxide ($Sb_2O_3$) and chromium oxide ($Cr_2O_3$) respectively in 0.5 mole %, and 0.005 mole % of $Al_2O_3$, the rest being zinc oxide (ZnO). On both surfaces of said sintered-body, an electrode material for a zinc oxide varistor was screen-printed to be 10 mm in diameter, and then baked at 800° C. for 10 min. to form electrodes 2. After lead wires 3 were soldered thereon, the outer periphery was with insulative resin 4 to obtain a sample.

With respect to the thus-obtained samples, voltage ratio ($V_{1\ mA}/V_{10\ \mu A}$), limit voltage ratio and surge current resistance characteristic are shown in the following Table 10. The voltage ratio and limit voltage ratio were obtained through determination using a direct current constant current electric source. Further, surge current resistance characteristic was obtained by determining a variation ratio of varistor voltage ($V_{1\ mA}$) occurring when an impact current of 8/20 μS standard waveform and 5000 A crest value was applied two times in the same direction. The number of samples was 10 per lot.

TABLE 9

| Designation of glass | Component ratio (wt. %) PbO | $B_2O_3$ | $SiO_2$ | $Y_2O_3$ | Tg (°C.) |
|---|---|---|---|---|---|
| A* | 70 | 15 | 15 | 0 | 405 |
| B | 69.9 | 15 | 15 | 0.1 | 405 |
| C | 60 | 15 | 15 | 10 | 425 |
| D | 45 | 15 | 15 | 25 | 470 |
| E | 40 | 15 | 15 | 30 | 490 |
| F* | 35 | 15 | 15 | 35 | 525 |
| G* | 30 | 34.9 | 35 | 0.1 | 545 |
| H | 40 | 29.9 | 30 | 0.1 | 520 |
| I* | 89.9 | 5 | 5 | 0.1 | 315 |
| J* | 60 | 0 | 15 | 25 | 455 |
| K | 55 | 5 | 15 | 25 | 465 |
| L | 50 | 30 | 15 | 5 | 475 |
| M* | 40 | 40 | 15 | 5 | 500 |
| N* | 60 | 15 | 0 | 25 | 460 |
| O | 55 | 15 | 5 | 25 | 470 |
| p | 50 | 15 | 30 | 5 | 510 |
| Q* | 40 | 15 | 40 | 5 | 530 |

*are comparative examination examples which are outside of the present invention.

TABLE 10

| Sample No. | Designation of glass | $V_{1\ mA}/V_{10\ \mu A}$ | Limit voltage ratio $V_{25\ A}/V_{1\ mA}$ | Surge current resistance characteristic $\Delta V_{1\ mA}$ (%) Direction same as that of current | Direction reverse to that of current |
|---|---|---|---|---|---|
| 1 | A* | 1.33 | 1.57 | −18.4 | −27.5 |
| 2 | B | 1.18 | 1.43 | −15.7 | −24.4 |
| 3 | C | 1.10 | 1.41 | −7.6 | −15.3 |
| 4 | D | 1.08 | 1.36 | −3.1 | −6.2 |

TABLE 10-continued

| Sample No. | Designation of glass | $V_{1\ mA}/V_{10\ \mu A}$ | Limit voltage ratio $V_{25\ A}/V_{1\ mA}$ | Surge current resistance characteristic $\Delta V_{1\ mA}$ (%) Direction same as that of current | Direction reverse to that of current |
|---|---|---|---|---|---|
| 5 | E | 1.15 | 1.36 | −5.3 | −8.8 |
| 6 | F* | 1.27 | 1.39 | −15.9 | −30.4 |
| 7 | G* | 1.15 | 1.55 | −21.3 | −31.1 |
| 8 | H | 1.18 | 1.46 | −15.3 | −24.9 |
| 9 | I* | 1.29 | 1.52 | −37.3 | −47.5 |
| 10 | J* | 1.27 | 1.53 | −17.1 | −26.2 |
| 11 | K | 1.18 | 1.45 | −10.8 | −17.4 |
| 12 | L | 1.12 | 1.42 | −10.2 | −18.6 |
| 13 | M* | 1.11 | 1.53 | −19.7 | −28.7 |
| 14 | N* | 1.19 | 1.49 | −18.3 | −28.2 |
| 15 | O | 1.18 | 1.43 | −12.4 | −16.9 |
| 16 | P | 1.16 | 1.45 | −10.9 | −18.3 |
| 17 | Q* | 1.19 | 1.47 | −22.1 | −31.7 |

*are comparative examination examples which are outside of the present invention.

At first, there is contemplated from Tables 9 and 10 the influence on voltage ratio (voltage nonlinearity), limit voltage ratio characteristic and surge current resistance characteristic by a $Y_2O_3$ content contained in a lead borosilicate-type glass frit in an electrode material for a zinc oxide varistor. As compared with the lead borosilicate glass of the conventional example containing no $Y_2O_3$, the composition systems having a $Y_2O_3$ content of 0.1% by weight or more are improved in voltage ratio (voltage nonlinearity) but those having a $Y_2O_3$ content in excess of 30.0% by weight will be deteriorated in surge current resistance. Accordingly, it is a necessary condition that lead borosilicate-type glass in an electrode material for zinc oxide varistor is a composition system containing at least 0.1–30.0% by weight of $Y_2O_3$.

On the other hand, since the limit voltage ratio characteristic ($V_{25\ A}/V_{1\ mA}$) and surge current resistance characteristic are affected by contents of PbO, $B_2O_3$ and $SiO_2$ in addition a $Y_2O_3$ content, these compositions are required to be considered. Therefore, influence on the limit voltage ratio and the surge current resistance characteristic by constituents of lead borosilicate-type glass contained in an electrode material for zinc oxide varistor will be considered on the basis of Tables 9 and 10. Glass of a composition system having a PbO content less than 40.0% by weight has a higher glass transition point and too small fluidity of glass, which result in a deterioration of solder-wetness of glass. Contrarily, glass of a composition system having PbO content of more than 80.0% by weight has a lower glass transition point Tg and too great a fluidity of glass, which result in a lower adhesion strength of an electrode. This lacks reliability. In a composition system having a $B_2O_3$ content of less than 5.0% by weight, surge current resistance characteristic becomes largely inferior.

On the other hand, in a composition system having a $B_2O_3$ content of more than 30.0% by weight, surge current resistance characteristic is also deteriorated. In a composition system having a $SiO_2$ content of less than 5.0% by weight, limit voltage ratio and surge current resistance characteristic are also deteriorated. In a composition a system having $SiO_2$ content of more than 30.0% by weight, surge current resistance characteristic will also become deteriorated.

From the above results is it is understandable that composition of glass components of electrode material for zinc oxide varistor is optimum to be in a range of 40.0–80.0% by weight of PbO, 5.0–30.0% by weight of $B_2O_3$, 5.0–30.0% by weight of $SiO_2$ and 0.1–30.0% by weight of $Y_2O_3$.

Although lead oxide, boron oxide, silicon oxide and antimony oxide were used, as material of lead borosilicate-type glass, in the forms of PbO, $B_2O_3$, $SiO_2$ and $Sb_2O_3$, respectively in the present working example, it was confirmed that similar characteristics could have also been obtained by using the other oxide forms. Further, the present working example refers only to the case in which a lead borosilicate-type glass content in an electrode material for a zinc oxide varistor was 5.0% by weight. However, so far as said content is within 1.0–30.0% by weight, no change is seen in the effect of the present invention. Furthermore, a zinc oxide varistor of a system consisting of ZnO, $Bi_2O_3$, $Co_3O_4$, $MnO_2$, NiO, $Sb_2O_3$, $Cr_2O_3$ and $Al_2O_3$ was produced into a sintered-body and then used for evaluation. However, even when the electrode material for a zinc oxide varistor according to the present invention is applied to a zinc oxide varistor containing $Pr_6O_{11}$, CaO, BaO, $Sb_2O_3$, $K_2O$, $SiO_2$, etc., no change is seen in effect.

(Working Example 6)

According to the composition list of the following Table 11, PbO, $B_2O_3$, $SiO_2$, $Co_2O_3$ and $Al_2O_3$ each was weighed in a given amount and then glass was produced by a procedure similar to that of the above Working Example 1, characteristics of the obtained glass are shown in Table 11.

Then, this glass was used to produce an electrode material for a zinc oxide varistor as in the above Working Example 1, and further said material was applied to the zinc oxide varistor element 1 used in the above Working Example 1to obtain electrode 2.

With respect to the thus-obtained samples, voltage ratio ($V_{1\ mA}/V_{10\ \mu A}$), limit voltage ratio ($V_{50\ A}/V_{1\ mA}$) and surge current resistance characteristic are shown in the following Table 12. Herein, the voltage ratio and limit voltage ratio were obtained through determination using a direct current constant current electric source. Further, the surge current resistance characteristic was obtained by determining a variation ratio of varistor voltage ($V_{1\ mA}$) occurring when an impact current of 8/20 μS standard waveform and 2500 A crest value was applied two times in the same direction. The number of Samples was 10 per lot.

TABLE 11

| Designation of glass | Component ratio (wt. %) PbO | $B_2O_3$ | $SiO_2$ | $Co_3O_4$ | $Al_2O_3$ | Tg (°C.) |
|---|---|---|---|---|---|---|
| A* | 70 | 15.0 | 15.0 | 0 | 0 | 405 |
| B* | 69.9 | 15.0 | 15.0 | 0.1 | 0 | 405 |

TABLE 11-continued

| Designation of glass | Component ratio (wt. %) PbO | $B_2O_3$ | $SiO_2$ | $Co_3O_4$ | $Al_2O_3$ | Tg (°C.) |
|---|---|---|---|---|---|---|
| C | 69.8999 | 15.0 | 15.0 | 0.1 | 0.0001 | 406 |
| D | 59.99 | 15.0 | 15.0 | 10.0 | 0.01 | 420 |
| E* | 50.0 | 15.0 | 15.0 | 20.0 | 0 | 453 |
| F | 49.9 | 15.0 | 15.0 | 20.0 | 0.1 | 455 |
| G | 49.0 | 15.0 | 15.0 | 20.0 | 1.0 | 458 |
| H* | 48.5 | 15.0 | 15.0 | 20.0 | 1.5 | 463 |
| I* | 40.0 | 15.0 | 15.0 | 30.0 | 0 | 475 |
| J | 40.0 | 14.9 | 15.0 | 30.0 | 0.1 | 476 |
| K* | 35.0 | 14.9 | 15.0 | 35.0 | 0.1 | 488 |
| L* | 30.0 | 34.9 | 35.0 | 0.1 | 0 | 545 |
| M* | 30.0 | 34.8 | 35.0 | 0.1 | 0.1 | 549 |
| N* | 40.0 | 29.9 | 30.0 | 0.1 | 0 | 520 |
| O | 40.0 | 29.8 | 30.0 | 0.1 | 0.1 | 526 |
| P* | 84.8 | 5.0 | 10.0 | 0.1 | 0.1 | 336 |
| Q* | 64.9 | 0 | 15.0 | 20.0 | 0.1 | 437 |
| R | 59.9 | 5.0 | 15.0 | 20.0 | 0.1 | 448 |
| S | 49.9 | 30.0 | 15.0 | 5.0 | 0.1 | 481 |
| T | 49.0 | 30.0 | 15.0 | 5.0 | 1.0 | 485 |
| U* | 44.9 | 35.0 | 15.0 | 5.0 | 0.1 | 496 |
| V* | 59.9 | 15.0 | 0 | 25.0 | 0.1 | 443 |
| W | 54.9 | 15.0 | 5.0 | 25.0 | 0.1 | 445 |
| X | 49.9 | 15.0 | 30.0 | 5.0 | 0.1 | 497 |
| Y | 49.0 | 15.0 | 3.0 | 5.0 | 1.0 | 506 |
| Z* | 44.9 | 15.0 | 35.0 | 5.0 | 0.1 | 510 |

*are comparative examination examples which are outside of the present invention.

At first, there is contemplated from Tables 11 and 12 the influence on voltage ratio (voltage nonlinearity), limit voltage ratio characteristic and surge current resistance characteristic by $Co_3O_4$ and $Al_2O_3$ contents contained in a lead borosilicate-type glass frit in an electrode material for a zinc oxide varistor. A composition system having a $Co_3O_4$ content of 0.1% by weight or more is improved in voltage ratio (voltage nonlinearity) but those having a $Co_3O_4$ content of more than 30.0% by weight will be deteriorated both in voltage ratio (voltage nonlinearity) and surge current resistance. Further, in a composition system having an $Al_2O_3$ content of $1.0\times10^{-4}$% by weight or more, limit voltage ratio characteristic is improved but in a composition system having an $Al_2O_3$ content of more than 1.0% by weight, voltage ratio (voltage nonlinearity) and surge current resistance will become deteriorated.

Accordingly, it is a necessary condition that lead borosilicate glass in an electrode material for a zinc oxide varistor is a composition system containing 0.1–30.0% by weight of $Co_3O_4$ and $1.0\times10^{-4}$–1.0% by weight of $Al_2O_3$.

On the other hand, surge current resistance characteristic and voltage ratio (voltage nonlinearity) are affected by contents of PbO, $B_2O_3$ and $SiO_2$ in addition to $Co_3O_4$ and $Al_2O_3$ contents. However, for similar reasons in the above working examples, it is understandable that composition of glass components of electrode material for zinc oxide varistor is optimum in a range of 40.0–80.0% by weight of PbO, 5.0–30.0% by weight of $B_2O_3$, 5.0–30.0% by weight of $SiO_2$ and 0.1–30.0% by weight of $Co_3O_4$, in addition to $1.0\times10^{-4}$–1.0% by weight of $Al_2O_3$.

TABLE 12

| Sample No. | Designation of glass | $V_{1\,mA}/V_{10\,\mu A}$ | Limit voltage ratio $V_{50\,A}/V_{1\,mA}$ | Surge current resistance characteristic $\Delta V_{1\,mA}$ (%) Direction same as that of current | Direction reverse to that of current |
|---|---|---|---|---|---|
| 1 | A* | 1.83 | 2.78 | −22.3 | −28.9 |
| 2 | B* | 1.52 | 2.56 | −10.9 | −18.0 |
| 3 | C | 1.53 | 2.24 | −10.8 | −18.3 |
| 4 | D | 1.38 | 1.96 | −9.6 | −14.4 |
| 5 | E* | 1.31 | 2.48 | −4.9 | −12.1 |
| 6 | F | 1.33 | 1.86 | −5.0 | −8.4 |
| 7 | G | 1.36 | 1.87 | −9.4 | −12.3 |
| 8 | H* | 1.42 | 1.88 | −12.6 | −15.7 |
| 9 | I* | 1.32 | 2.33 | −8.8 | −11.9 |
| 10 | J | 1.37 | 2.26 | −10.5 | −12.5 |
| 11 | K* | 1.70 | 2.24 | −20.9 | −28.0 |
| 12 | L* | 1.51 | 2.31 | −16.2 | −23.5 |
| 13 | M* | 1.53 | 2.14 | −15.8 | −34.6 |
| 14 | N* | 1.54 | 2.12 | −12.8 | −35.6 |
| 15 | O | 1.52 | 1.95 | −10.3 | −13.4 |
| 16 | P* | 1.73 | 2.00 | −18.2 | −32.3 |
| 17 | Q* | 1.41 | 2.21 | −20.3 | −26.1 |
| 18 | R | 1.39 | 2.19 | −10.8 | −15.4 |
| 19 | S | 1.40 | 2.31 | −9.8 | −21.7 |
| 20 | T | 1.47 | 2.25 | −11.6 | −20.2 |
| 21 | U* | 1.43 | 2.18 | −20.3 | −22.6 |
| 22 | V* | 1.38 | 2.24 | −26.3 | −30.1 |
| 23 | W | 1.42 | 1.96 | −12.1 | −16.8 |
| 24 | X | 1.38 | 2.11 | −18.0 | −18.0 |
| 25 | Y | 1.46 | 2.02 | −11.8 | −20.3 |
| 26 | Z* | 1.51 | 2.38 | −21.5 | −29.6 |

*are comparative examination examples which are outside of the present invention.

Although aluminium oxide ($Al_{2O3}$) was used in the present working example, it was confirmed that the similar results could have also been obtained by using at least one of indium oxide ($In_2O_3$), gallium oxide ($Ga_2O_3$) and germanium oxide ($GeO_2$) in an amount of $1.0\times10^{-4}$–1.0% by weight, in place of aluminium oxide. Also, it was confirmed that when combination of these oxides was used, a similar effect could have been obtained.

(Working Example 7)

According to the composition list of the following Table 13, PbO, $B_2O_3$, $SiO_2$, MgO and $Al_2O_3$ were each weighed in a given amount, and then glass was produced by a procedure similar to that of the above working examples. Characteristics of the obtained glass are shown in Table 13.

Then, this glass was used to produce an electrode material for a zinc oxide varistor in a similar manner to that of the above working examples, and further, said material was applied to the varistor element 1 used in the above working example, which was followed by estimation by a similar method. The results are shown in Table 14.

TABLE 13

| Designation of glass | Component ratio (wt. %) PbO | $B_2O_3$ | $SiO_2$ | MgO | $Al_2O_3$ | Tg (°C.) |
|---|---|---|---|---|---|---|
| A* | 70 | 15.0 | 15.0 | 0 | 0 | 405 |
| B* | 69.9 | 15.0 | 15.0 | 0.1 | 0 | 405 |
| C | 69.8999 | 15.0 | 15.0 | 0.1 | 0.0001 | 406 |
| D | 59.99 | 15.0 | 15.0 | 10.0 | 0.01 | 420 |
| E* | 50.0 | 15.0 | 15.0 | 20.0 | 0 | 410 |

TABLE 13-continued

| Designation of glass | Component ratio (wt. %) PbO | $B_2O_3$ | $SiO_2$ | MgO | $Al_2O_3$ | Tg (°C.) |
|---|---|---|---|---|---|---|
| F | 49.9 | 15.0 | 15.0 | 20.0 | 0.1 | 416 |
| G | 49.0 | 15.0 | 15.0 | 20.0 | 1.0 | 422 |
| H* | 48.5 | 15.0 | 15.0 | 20.0 | 1.5 | 430 |
| I* | 40.0 | 15.0 | 15.0 | 30.0 | 0 | 420 |
| J | 40.0 | 14.9 | 15.0 | 30.0 | 0.1 | 426 |
| K* | 35.0 | 14.9 | 15.0 | 35.0 | 0.1 | 445 |
| L* | 30.0 | 34.9 | 35.0 | 0.1 | 0 | 545 |
| M* | 30.0 | 34.8 | 35.0 | 0.1 | 0.1 | 552 |
| N* | 40.0 | 29.9 | 30.0 | 0.1 | 0 | 520 |
| O | 40.0 | 29.8 | 30.0 | 0.1 | 0.1 | 526 |
| P* | 84.8 | 5.0 | 10.0 | 0.1 | 0.1 | 336 |
| Q* | 64.9 | 0 | 15.0 | 20.0 | 0.1 | 405 |
| R | 59.9 | 5.0 | 15.0 | 20.0 | 0.1 | 410 |
| S | 49.9 | 30.0 | 15.0 | 5.0 | 0.1 | 471 |
| T | 49.0 | 30.0 | 15.0 | 5.0 | 1.0 | 480 |
| U* | 44.9 | 35.0 | 15.0 | 5.0 | 0.1 | 493 |
| V* | 59.9 | 15.0 | 0 | 25.0 | 0.1 | 420 |
| W | 54.9 | 15.0 | 5.0 | 25.0 | 0.1 | 435 |
| X | 49.9 | 15.0 | 30.0 | 5.0 | 0.1 | 496 |
| Y | 49.0 | 15.0 | 30.0 | 5.0 | 1.0 | 502 |
| Z* | 44.9 | 15.0 | 35.0 | 5.0 | 0.1 | 506 |

*are comparative examination examples which are outside of the present invention.

TABLE 14

| Sample No. | Designation of glass | $V_{1\ mA}/V_{10\ \mu A}$ | Limit voltage ratio $V_{50\ A}/V_{1\ mA}$ | Surge current resistance characteristic $\Delta V_{1\ mA}$ (%) Direction same as that of current | Direction reverse to that of current |
|---|---|---|---|---|---|
| 1 | A* | 1.83 | 2.78 | −22.3 | −28.9 |
| 2 | B* | 1.50 | 2.48 | −11.2 | −18.3 |
| 3 | C | 1.49 | 2.16 | −10.7 | −18.8 |
| 4 | D | 1.36 | 1.93 | −5.9 | −8.7 |
| 5 | E* | 1.24 | 1.88 | −5.3 | −7.8 |
| 6 | F | 1.29 | 1.80 | −4.0 | −7.2 |
| 7 | G | 1.33 | 1.86 | −8.1 | −11.4 |
| 8 | H* | 1.41 | 1.89 | −13.2 | −16.0 |
| 9 | I* | 1.35 | 2.44 | −7.4 | −11.7 |
| 10 | J | 1.38 | 2.19 | −9.6 | −13.2 |
| 11 | K* | 1.69 | 2.32 | −19.1 | −30.6 |
| 12 | L* | 1.51 | 2.46 | −17.8 | −24.1 |
| 13 | M* | 1.55 | 2.08 | −15.3 | −33.7 |
| 14 | N* | 1.45 | 2.49 | −11.4 | −28.4 |
| 15 | O | 1.55 | 1.92 | −10.5 | −14.2 |
| 16 | P* | 1.71 | 2.02 | −18.0 | −27.7 |
| 17 | Q* | 1.40 | 2.30 | −13.9 | −31.4 |
| 18 | R | 1.35 | 2.13 | −11.6 | −12.7 |
| 19 | S | 1.37 | 2.24 | −12.1 | −13.8 |
| 20 | T | 1.41 | 2.20 | −12.5 | −19.1 |
| 21 | U* | 1.43 | 2.08 | −19.4 | −28.5 |
| 22 | V* | 1.41 | 2.12 | −25.5 | −30.6 |
| 23 | W | 1.40 | 1.93 | −11.3 | −17.3 |
| 24 | X | 1.37 | 2.09 | −9.4 | −17.7 |
| 25 | Y | 1.44 | 1.97 | −10.9 | −18.9 |
| 26 | Z* | 1.53 | 2.21 | −20.6 | −30.1 |

*are comparative examination examples which are outside of the present invention.

At first, there is contemplated from Tables 13 and 14 the influence on voltage ratio (voltage nonlinearity), limit voltage ratio characteristic and surge current resistance characteristic by MgO and $Al_2O_3$ contents contained in a lead borosilicate-type glass frit in an electrode material for a zinc oxide varistor. A composition system having a MgO content of 0.1% by weight or more is improved in voltage ratio (voltage nonlinearity) but that having a MgO content of more than 30.0% by weight will be deteriorated in surge current resistance characteristic. Further, a composition system having an $Al_2O_3$ content of $1.0\times10^{-4}$% by weight or more is improved in limit voltage ratio characteristic but a composition system having an $Al_2O_3$ content in excess of 1.0% by weight will become deteriorated in surge current resistance characteristic.

Accordingly, it is a necessary condition that lead borosilicate glass in an electrode material for zinc oxide varistor is a composition system containing 0.1–30.0% by weight of MgO and $1.0\times10^{-4}$–1.0% by weight of $Al_2O_3$.

On the other hand, surge current resistance characteristic and voltage ratio (voltage nonlinearity) are affected by contents of PbO, $B_2O_3$ and $SiO_2$ in addition to MgO and $Al_2O_3$ contents. By similar reasons in the above working examples, it is understandable that composition of glass components of electrode material for a zinc oxide varistor is optimum in a range of 40.0–80.0% by weight of PbO, 5.0–30.0% by weight of $B_2O_3$, 5.0–30.0% by weight of $SiO_2$, 0.1–30.0% by weight of MgO and $1.0\times10^{-4}$–1.0% by weight of at least one chemical element selected from $Al_2O_3$, $In_2O_3$, $Ga_2O_3$ and $GeO_2$.

Aluminium oxide ($Al_2O_3$) was used in the present working example, it was confirmed that similar results could have also been obtained even when indium oxide ($In_2O_3$), gallium oxide ($Ga_2O_3$) and germanium oxide ($GeO_2$) were used in place of aluminium oxide. Also, it was confirmed that when a combination of these oxides was used, similar results could have been obtained.

(Working Example 8)

Hereinunder, detailed explanation is made for the 8th working example of the present invention.

According to composition list of the following Table 15, PbO, $B_2O_3$, $SiO_2$, $Y_2O_3$ and $Al_2O_3$ were each weighed each in a given amount, and then glass was produced by a procedure similar to that of the above working examples. Characteristics of the obtained glass are shown in Table 15.

Then, this glass was used to produce an electrode material for zinc oxide varistor in a similar manner to that of the above working examples, and further, said material was applied to the varistor element 1 used in the above working example to form an electrode, which was followed by evaluation by a similar method. The results are shown in Table 16.

TABLE 15

| Designation of glass | Component ratio (wt. %) PbO | $B_2O_3$ | $SiO_2$ | $Y_2O_3$ | $Al_2O_3$ | Tg (°C.) |
|---|---|---|---|---|---|---|
| A* | 70 | 15.0 | 15.0 | 0 | 0 | 405 |
| B* | 69.9 | 15.0 | 15.0 | 0.1 | 0 | 405 |
| C | 69.8999 | 15.0 | 15.0 | 0.1 | 0.0001 | 406 |
| D | 59.99 | 15.0 | 15.0 | 10.0 | 0.01 | 427 |
| E* | 50.0 | 15.0 | 15.0 | 20.0 | 0 | 460 |
| F | 49.9 | 15.0 | 15.0 | 20.0 | 0.1 | 465 |
| G | 49.0 | 15.0 | 15.0 | 20.0 | 1.0 | 467 |
| H* | 48.5 | 15.0 | 15.0 | 20.0 | 1.5 | 473 |
| I | 40.0 | 15.0 | 15.0 | 30.0 | 0 | 490 |
| J | 40.0 | 14.9 | 15.0 | 30.0 | 0.1 | 496 |
| K* | 35.0 | 14.9 | 15.0 | 35.0 | 0.1 | 526 |
| L* | 30.0 | 34.9 | 35.0 | 0.1 | 0 | 545 |
| M* | 30.0 | 34.8 | 35.0 | 0.1 | 0.1 | 544 |
| N* | 40.0 | 29.9 | 30.0 | 0.1 | 0 | 520 |
| O | 40.0 | 29.8 | 30.0 | 0.1 | 0.1 | 523 |
| P* | 84.8 | 5.0 | 10.0 | 0.1 | 0.1 | 330 |
| Q* | 64.9 | 0 | 15.0 | 20.0 | 0.1 | 453 |
| R | 59.9 | 5.0 | 15.0 | 20.0 | 0.1 | 459 |
| S | 49.9 | 30.0 | 15.0 | 5.0 | 0.1 | 478 |
| T | 49.0 | 30.0 | 15.0 | 5.0 | 1.0 | 487 |
| U* | 44.9 | 35.0 | 15.0 | 5.0 | 0.1 | 493 |
| V* | 59.9 | 15.0 | 0 | 25.0 | 0.1 | 463 |
| W | 54.9 | 15.0 | 5.0 | 25.0 | 0.1 | 478 |
| X | 49.9 | 15.0 | 30.0 | 5.0 | 0.1 | 510 |
| Y | 49.0 | 15.0 | 30.0 | 5.0 | 1.0 | 517 |
| Z* | 44.9 | 15.0 | 35.0 | 5.0 | 0.1 | 524 |

*are comparative examination examples which are outside of the present invention.

TABLE 16

| Sample No. | Designation of glass | $V_{1\,mA}/V_{10\,\mu A}$ | Limit voltage ratio $V_{50\,A}/V_{1\,mA}$ | Surge current resistance characteristic $\Delta V_{1\,mA}$ (%) Direction same as that of current | Direction reverse to that of current |
|---|---|---|---|---|---|
| 1 | A* | 1.83 | 2.78 | −22.3 | −28.9 |
| 2 | B* | 1.52 | 2.57 | −10.8 | −18.3 |
| 3 | C | 1.49 | 2.32 | −11.4 | −18.6 |
| 4 | D | 1.40 | 2.01 | −8.9 | −15.4 |
| 5 | E* | 1.33 | 2.51 | −3.8 | −7.2 |
| 6 | F | 1.36 | 1.92 | −6.7 | −7.5 |
| 7 | G | 1.40 | 1.91 | −8.9 | −13.6 |
| 8 | H* | 1.39 | 1.94 | −11.3 | −14.2 |
| 9 | I* | 1.40 | 2.38 | −9.2 | −12.5 |
| 10 | J | 1.35 | 2.22 | −11.6 | −13.3 |
| 11 | K* | 1.66 | 2.19 | −10.3 | −27.9 |
| 12 | L* | 1.52 | 2.33 | −15.6 | −28.3 |
| 13 | M* | 1.49 | 2.17 | −15.8 | −31.5 |
| 14 | N* | 1.53 | 2.09 | −18.2 | −34.2 |
| 15 | O | 1.48 | 2.10 | −11.3 | −12.9 |
| 16 | P* | 1.74 | 2.13 | −20.3 | −29.8 |
| 17 | Q* | 1.43 | 2.24 | −21.1 | −26.7 |
| 18 | R | 1.40 | 2.18 | −9.3 | −11.5 |
| 19 | S | 1.41 | 2.29 | −7.8 | −18.4 |
| 20 | T | 1.46 | 2.24 | −10.3 | −19.8 |
| 21 | U* | 1.40 | 2.12 | −19.7 | −24.3 |
| 22 | V* | 1.37 | 2.30 | −25.8 | −31.0 |
| 23 | W | 1.46 | 1.82 | −11.8 | −17.1 |

TABLE 16-continued

| Sample No. | Designation of glass | $V_{1\ mA}/V_{10\ \mu A}$ | Limit voltage ratio $V_{50\ A}/V_{1\ mA}$ | Surge current resistance characteristic $\Delta V_{1\ mA}$ (%) Direction same as that of current | Direction reverse to that of current |
|---|---|---|---|---|---|
| 24 | X | 1.39 | 2.16 | −10.2 | −17.3 |
| 25 | Y | 1.45 | 1.99 | −10.9 | −19.5 |
| 26 | Z* | 1.49 | 2.33 | −20.4 | −28.1 |

*are comparative examination examples which are outside of the present invention.

At first, there is contemplated from Tables 15 and 16 the influence on voltage ratio (voltage nonlinearity), limit voltage ratio characteristic and surge current resistance characteristic by $Y_2O_3$ and $Al_2O_3$ contents contained in a lead borosilicate-type glass frit in an electrode material for a zinc oxide varistor. A composition system having a $Y_2O_3$ content of 0.1% by weight or more are improved in voltage ratio (voltage nonlinearity) and surge current resistance characteristic but that having a $Y_2O_3$ content of more than 30.0% by weight will be deteriorated in both voltage ratio (voltage nonlinearity) as well as surge current resistance characteristic. Further, a composition system having an $Al_2O_3$ content of $1.0\times10^{-4}$% by weight or more is improved in limit voltage ratio characteristic but a composition system having an $Al_2O_3$ content in excess of 1.0% by weight will become deteriorated in surge current resistance characteristic.

Accordingly, it is a necessary condition that lead borosilicate glass in an electrode material for zinc oxide varistor is a composition system containing 0.1–30.0% by weight of $Y_2O_3$ and $1.0\times10^{-4}$–1.0% by weight of $Al_2O_3$.

On the other hand, surge current resistance characteristic and voltage ratio (voltage nonlinearity) are affected by contents of PbO, $B_2O_3$ and $SiO_2$ in addition to the $Y_2O_3$ and $Al_2O_3$ contents. For similar reasons in the above working examples, it is understandable that composition of glass components of electrode material for zinc oxide varistor is optimum to be in a range of 40.0–80.0% by weight of PbO, 5.0–30.0% by weight of $B_2O_3$, 5.0–30.0% by weight of $SiO_2$, 0.1–30.0% by weight of $Y_2O_3$ and $1.0\times10^{-4}$–1.0% by weight of at least one chemical element selected from $Al_2O_3$, $In_2O_3$, $Ga_2O_3$ and $GeO_2$.

Aluminium oxide ($Al_2O_3$) was used in the present working example, but it was confirmed that the similar results could have also been obtained even when indium oxide ($In_2O_3$), gallium oxide ($Ga_2O_3$) and germanium oxide ($GeO_2$) were used in place of aluminium oxide. Also, it was confirmed that when a combination of these oxides was used, similar results could have been obtained.

(Working Example 9)

Hereinunder, detailed explanation is made for the 9th working example of the present invention.

According to the composition list of the following Table 17, PbO, $B_2O_3$, $SiO_2$, $Sb_2O_3$ and $Al_2O_3$ were each weighed in a given amount, and then glass was produced by the procedure similar to that of the above working examples. Characteristics of the obtained glass are shown in Table 17.

Then, this glass was used to produce an electrode material for a zinc oxide varistor in a similar manner to that of the above working examples, and further, said material was applied to the varistor element 1 used in the above working examples to form electrodes 2, which was followed by evaluation in a similar method. The results are shown in Table 18.

Table 17

| Designation of glass | Component ratio (wt. %) PbO | $B_2O_3$ | $SiO_2$ | $Sb_2O_3$ | $Al_2O_3$ | Tg (°C.) |
|---|---|---|---|---|---|---|
| A* | 70 | 15.0 | 15.0 | 0 | 0 | 405 |
| B* | 69.9 | 15.0 | 15.0 | 0.1 | 0 | 405 |
| C | 69.8999 | 15.0 | 15.0 | 0.1 | 0.0001 | 407 |
| D | 59.99 | 15.0 | 15.0 | 10.0 | 0.01 | 438 |
| E* | 50.0 | 15.0 | 15.0 | 20.0 | 0 | 460 |
| F | 49.9 | 15.0 | 15.0 | 20.0 | 0.1 | 463 |
| G | 49.0 | 15.0 | 15.0 | 20.0 | 1.0 | 468 |
| H* | 48.5 | 15.0 | 15.0 | 20.0 | 1.5 | 471 |
| I* | 40.0 | 15.0 | 15.0 | 30.0 | 0 | 480 |
| J | 40.0 | 14.9 | 15.0 | 30.0 | 0.1 | 487 |
| K* | 35.0 | 14.9 | 15.0 | 35.0 | 0.1 | 520 |
| L* | 30.0 | 34.9 | 35.0 | 0.1 | 0 | 545 |
| M* | 30.0 | 34.8 | 35.0 | 0.1 | 0.1 | 550 |
| N* | 40.0 | 29.9 | 30.0 | 0.1 | 0 | 520 |
| O | 40.0 | 29.8 | 30.0 | 0.1 | 0.1 | 526 |
| P* | 84.8 | 5.0 | 10.0 | 0.1 | 0.1 | 339 |
| Q* | 64.9 | 0 | 15.0 | 20.0 | 0.1 | 452 |
| R | 59.9 | 5.0 | 15.0 | 20.0 | 0.1 | 457 |
| S | 49.9 | 30.0 | 15.0 | 5.0 | 0.1 | 498 |
| T | 49.0 | 30.0 | 15.0 | 5.0 | 1.0 | 522 |
| U* | 44.9 | 35.0 | 15.0 | 5.0 | 0.1 | 535 |
| V* | 59.9 | 15.0 | 0 | 25.0 | 0.1 | 451 |
| W | 54.9 | 15.0 | 5.0 | 25.0 | 0.1 | 464 |
| X | 49.9 | 15.0 | 30.0 | 5.0 | 0.1 | 526 |
| Y | 49.0 | 15.0 | 30.0 | 5.0 | 1.0 | 531 |
| Z* | 44.9 | 15.0 | 35.0 | 5.0 | 0.1 | 540 |

*are comparative examination examples which are outside of the present invention.

TABLE 18

| Sample No. | Designation of glass | $V_{1\ mA}/V_{10\ \mu A}$ | $V_{50\ A}/V_{1\ mA}$ | Surge current resistance characteristic $\Delta V_{1\ mA}$ (%) Direction same as that of current | Direction reverse to that of current |
|---|---|---|---|---|---|
| 1 | A* | 1.83 | 2.78 | −22.3 | −28.9 |
| 2 | B* | 1.61 | 2.52 | −11.0 | −18.3 |
| 3 | C | 1.55 | 2.36 | −10.5 | −17.9 |
| 4 | D | 1.38 | 2.12 | −9.3 | −14.2 |

TABLE 18-continued

| Sample No. | Designation of glass | $V_{1\ mA}/V_{10\ \mu A}$ | $V_{50\ A}/V_{1\ mA}$ | Surge current resistance characteristic $\Delta V_{1\ mA}$ (%) Direction same as that of current | Direction reverse to that of current |
|---|---|---|---|---|---|
| 5 | E* | 1.35 | 2.23 | −6.8 | −9.2 |
| 6 | F | 1.36 | 1.92 | −7.7 | −8.3 |
| 7 | G | 1.39 | 1.87 | −10.9 | −12.4 |
| 8 | H* | 1.37 | 1.89 | −13.3 | −15.2 |
| 9 | I* | 1.41 | 2.34 | −9.6 | −12.9 |
| 10 | J | 1.35 | 2.15 | −10.8 | −13.4 |
| 11 | K* | 1.45 | 2.29 | −14.3 | −29.9 |
| 12 | L* | 1.54 | 2.31 | −15.8 | −28.5 |
| 13 | M* | 1.48 | 2.18 | −16.1 | −32.0 |
| 14 | N | 1.53 | 2.16 | −17.2 | −34.7 |
| 15 | O | 1.45 | 2.13 | −12.3 | −13.6 |
| 16 | P* | 1.69 | 2.10 | −20.7 | −30.4 |
| 17 | Q | 1.41 | 2.41 | −21.5 | −27.1 |
| 18 | R | 1.43 | 2.28 | −9.7 | −12.0 |
| 19 | S | 1.43 | 2.39 | −10.9 | −17.4 |
| 20 | T | 1.45 | 2.24 | −11.3 | −18.7 |
| 21 | U* | 1.46 | 2.31 | −20.3 | −25.9 |
| 22 | V* | 1.40 | 2.29 | −26.7 | −32.8 |
| 23 | W | 1.45 | 2.02 | −12.8 | −16.8 |
| 24 | X | 1.42 | 2.21 | −12.1 | −17.2 |
| 25 | Y | 1.46 | 1.96 | −11.2 | −18.3 |
| 26 | Z* | 1.47 | 2.27 | −21.4 | −27.5 |

*are comparative examination examples which are outside of the present invention.

At first, there is contemplated from Tables 17 and 18 the influence on voltage ratio (voltage nonlinearity), limit voltage ratio characteristic and surge current resistance characteristic by $Sb_2O_3$ and $Al_2O_3$ contents contained in a lead borosilicate-type glass frit in an electrode material for a zinc oxide varistor. A composition system having an $Sb_2O_3$ content of 0.1% by weight or more is improved in voltage ratio (voltage nonlinearity) and surge current resistance characteristic but that having a $Sb_2O_3$ content of more than 30.0% by weight will be deteriorated in surge current resistance characteristic. Further, a composition system having an $Al_2O_3$ content of $1.0\times10^{-4}$% by weight or more is improved in limit voltage ratio characteristic but a composition system having an $Al_2O_3$ content in excess of 1.0% by weight will become deteriorated in surge current resistance characteristic.

Accordingly, it is a necessary condition that lead borosilicate glass in an electrode material for a zinc oxide varistor is a composition system containing 0.1–30.0% by weight of $Sb_2O_3$ and $1.0\times10^{-4}$–1.0% by weight of $Al_2O_3$.

On the other hand, surge current resistance characteristic and voltage ratio (voltage nonlinearity) are affected by contents of PbO, $B_2O_3$ and $SiO_2$ in addition to $Sb_2O_3$ and $Al_2O_3$ contents. For similar reasons as in the above working examples, it is understandable that composition of glass components of electrode material for a zinc oxide varistor is optimum in a range of 40.0–80.0% by weight of PbO, 5.0–30.0% by weight of $B_2O_3$, 5.0–30.0% by weight of $SiO_2$, 0.1–30.0% by weight of $Sb_2O_3$ and $1.0\times10^{-4}$–1.0% by weight of at least one chemical element selected from $Al_2O_3$, $In_2O_3$, $Ga_2O_3$ and $GeO_2$.

Aluminium oxide ($Al_2O_3$) was used in the present working example, it was confirmed that similar results could also have been obtained even when indium oxide ($In_2O_3$), gallium oxide ($Ga_2O_3$) and germanium oxide ($GeO_2$) were used in place of aluminium oxide. Also, it was confirmed that when a combination of these oxides was used, the similar results could have been obtained.

(Working Example 10)

Hereinunder, detailed explanation is made for the 10th working example of the present invention.

According to the composition list of the following Table 19, PbO, $B_2O_3$, $SiO_2$, $MnO_2$ and $Al_2O_3$ were each weighed in a given amount, and then glass was produced by a procedure similar to that of the above working examples. Characteristics of the obtained glass are shown in Table 19.

Then, this glass was used to produce an electrode material for zinc oxide varistor in a similar manner to that of the above working examples, and further, said material was applied to the varistor element 1 used in the above working examples to form electrodes 2, which was followed by evaluation by a similar method. The results are shown in Table 20.

TABLE 19

| Designation of glass | Component ratio (wt. %) PbO | $B_2O_3$ | $SiO_2$ | $MnO_2$ | $Al_2O_3$ | Tg (°C.) |
|---|---|---|---|---|---|---|
| A* | 70 | 15.0 | 15.0 | 0 | 0 | 405 |
| B* | 69.9 | 15.0 | 15.0 | 0.1 | 0 | 405 |
| C | 69.8999 | 15.0 | 15.0 | 0.1 | 0.0001 | 405 |
| D | 59.99 | 15.0 | 15.0 | 10.0 | 0.01 | 431 |
| E* | 50.0 | 15.0 | 15.0 | 20.0 | 0 | 470 |
| F | 49.9 | 15.0 | 15.0 | 20.0 | 0.1 | 473 |
| G | 49.0 | 15.0 | 15.0 | 20.0 | 1.0 | 480 |
| H* | 48.5 | 15.0 | 15.0 | 20.0 | 1.5 | 485 |
| I* | 40.0 | 15.0 | 15.0 | 30.0 | 0 | 495 |
| J | 40.0 | 14.9 | 15.0 | 30.0 | 0.1 | 502 |
| K* | 35.0 | 14.9 | 15.0 | 35.0 | 0.1 | 533 |
| L* | 30.0 | 34.9 | 35.0 | 0.1 | 0 | 545 |
| M* | 30.0 | 34.8 | 35.0 | 0.1 | 0.1 | 551 |
| N* | 40.0 | 29.9 | 30.0 | 0.1 | 0 | 520 |
| O | 40.0 | 29.8 | 30.0 | 0.1 | 0.1 | 525 |
| P* | 84.8 | 5.0 | 10.0 | 0.1 | 0.1 | 327 |
| Q* | 64.9 | 0 | 15.0 | 20.0 | 0.1 | 458 |

TABLE 19-continued

| Designation of glass | Component ratio (wt. %) PbO | $B_2O_3$ | $SiO_2$ | $MnO_2$ | $Al_2O_3$ | Tg (°C.) |
|---|---|---|---|---|---|---|
| R | 59.9 | 5.0 | 15.0 | 20.0 | 0.1 | 466 |
| S | 49.9 | 30.0 | 15.0 | 5.0 | 0.1 | 490 |
| T | 49.0 | 30.0 | 15.0 | 5.0 | 1.0 | 500 |
| U* | 44.9 | 35.0 | 15.0 | 5.0 | 0.1 | 515 |
| V* | 59.9 | 15.0 | 0 | 25.0 | 0.1 | 457 |
| W | 54.9 | 15.0 | 5.0 | 25.0 | 0.1 | 460 |
| X | 49.9 | 15.0 | 30.0 | 5.0 | 0.1 | 519 |
| Y | 49.0 | 15.0 | 30.0 | 5.0 | 1.0 | 528 |
| Z* | 44.9 | 15.0 | 35.0 | 5.0 | 0.1 | 536 |

*are comparative examination examples which are outside of the present invention.

$Al_2O_3$ content in excess of 1.0% by weight will become deteriorated in surge current resistance characteristic.

Accordingly, it is a necessary condition that lead borosilicate glass in an electrode material for a zinc oxide varistor is a composition system containing 0.1–30.0% by weight of $MnO_2$ and $1.0\times10^{-4}$–1.0% by weight of $Al_2O_3$.

On the other hand, surge current resistance characteristic and voltage ratio (voltage nonlinearity) are affected by contents of PbO, $B_2O_3$ and $SiO_2$ in addition to $MnO_2$ and $Al_2O_3$ contents. For similar reasons in the above working examples, it is understandable that composition of glass components of electrode material for a zinc oxide varistor is optimum to be in a range of 40.0–80.0% by weight of PbO, 5.0–30.0% by weight of $B_2O_3$, 5.0–30.0% by weight of $SiO_2$, 0.1–30.0% by weight of $MnO_2$ and $1.0\times10^{-4}$–1.0% by weight of at least one chemical element selected from $Al_2O_3$, $In_2O_3$, $Ga_2O_3$ and $GeO_2$.

TABLE 20

| Sample No. | Designation of glass | $V_{1\ mA}/V_{10\ \mu A}$ | $V_{50\ A}/V_{1\ mA}$ | Surge current resistance characteristic $\Delta V_{1\ mA}$ (%) Direction same as that of current | Direction reverse to that of current |
|---|---|---|---|---|---|
| 1 | A* | 1.83 | 2.78 | −22.3 | −28.9 |
| 2 | B* | 1.53 | 2.56 | −11.1 | −17.8 |
| 3 | C | 1.49 | 2.36 | −9.9 | −12.4 |
| 4 | D | 1.38 | 1.89 | −5.1 | −8.7 |
| 5 | E* | 1.32 | 2.39 | −7.8 | −13.6 |
| 6 | F | 1.37 | 1.92 | −12.7 | −14.9 |
| 7 | G | 1.41 | 1.89 | −9.5 | −13.0 |
| 8 | H* | 1.45 | 1.91 | −12.3 | −16.3 |
| 9 | I* | 1.39 | 2.20 | −9.7 | −12.6 |
| 10 | J | 1.44 | 2.18 | −11.6 | −13.4 |
| 11 | K* | 1.58 | 2.07 | −18.9 | −29.2 |
| 12 | L* | 1.52 | 2.29 | −16.3 | −24.1 |
| 13 | M* | 1.49 | 2.21 | −14.9 | −35.5 |
| 14 | N* | 1.50 | 2.20 | −12.6 | −33.1 |
| 15 | O | 1.48 | 1.88 | −11.6 | −14.2 |
| 16 | P* | 1.69 | 1.93 | −16.9 | −30.3 |
| 17 | Q* | 1.43 | 2.23 | −19.7 | −28.9 |
| 18 | R | 1.38 | 2.12 | −11.4 | −14.7 |
| 19 | S | 1.42 | 2.29 | −10.2 | −23.1 |
| 20 | T | 1.48 | 2.24 | −10.9 | −20.5 |
| 21 | U* | 1.45 | 2.33 | −21.5 | −23.3 |
| 22 | V* | 1.39 | 2.27 | −25.8 | −31.4 |
| 23 | W | 1.40 | 1.95 | −12.3 | −15.9 |
| 24 | X | 1.39 | 2.16 | −11.7 | −17.4 |
| 25 | Y | 1.45 | 1.98 | −10.9 | −19.1 |
| 26 | Z* | 1.50 | 2.30 | −20.8 | −30.2 |

*are comparative examination examples which are outside of the present invention.

At first, there is contemplated from Tables 19 and 20 the influence on voltage ratio (voltage nonlinearity), limit voltage ratio characteristic and surge current resistance characteristic by $MnO_2$ and $Al_2O_3$ contents contained in a lead borosilicate-type glass frit in an electrode material for zinc oxide varistor. A composition system having a $MnO_2$ content of 0.1% by weight or more is improved in voltage ratio (voltage nonlinearity) and surge current resistance characteristic but that having a $MnO_2$ content of more than 30.0% by weight will be deteriorated in both voltage ratio (voltage nonlinearity) and surge current resistance characteristic. Further, a composition system having an $Al_2O_3$ content of $1.0\times10^{-4}$% by weight or more is improved in limit voltage ratio characteristic but a composition system having an Aluminium oxide ($Al_2O_3$) was used in the present working example, it was confirmed that the similar results could have also been obtained even when indium oxide ($In_2O_3$), gallium oxide ($Ga_2O_3$) and germanium oxide ($GeO_2$) were used in place of aluminium oxide. Also, it was confirmed that when a combination of these oxides was used, similar results could have been obtained.

Further, lead oxide, boron oxide, silicon oxide, manganese oxide, aluminium oxide and indium oxide were used, as material of lead borosilicate-type glass, in the forms of PbO, $B_2O_3$, $SiO_2$, $MnO_2$, $Al_2O_3$ and $In_2O_3$, respectively in the present working examples 6–10. However, it was confirmed that the similar physical properties could have also been obtained by using the other oxide forms. Further, the present working examples 6–10 referred only to the case in which lead borosilicate-type glass content in electrode material for a zinc oxide varistor was 5.0% by weight, but so far as said content is within 1.0–30.0% by weight, no change is seen in the effect of the present invention. Furthermore, zinc oxide varistors of systems consisting of ZnO, $Bi_2O_3$, $Co_2O_3$, $MnO_2$, NiO, $TiO_2$, $Sb_2O_3$, $Cr_2O_3$ and $Al_2O_3$ were used as a sintered-body (varistor element 1) for evaluation. However, even when the electrode material for zinc oxide varistor according to the present invention is applied to a zinc oxide varistor containing $Pr_6O_{11}$, CaO, BaO, MgO, $K_2O$, $SiO_2$, etc., no change is seen in effect.

(Working Example 11)

Hereinunder, detailed explanation is made for the 11th working example of the present invention.

At first, the description refers to formulation of glass frit to be incorporated to electrode material for a zinc oxide varistor. According to the composition list of the following Table 21, PbO, $B_2O_3$, $SiO_2$ and $TeO_2$ each weighed in a given amount were mixed and simultaneously ground in a ball mill, and then fused under a temperature condition of 1000° C.–1500° C. in a Pt-crucible, which was followed by quenched to be glassified. The thus-obtained glass was roughly crushed and then finely milled in a ball mill to obtain lead borosilicate-type glass frit. Also, glass powder composed of 70.0% by weight of PbO, 15.0% by weight of $B_2O_3$ and 15.0% by weight of $SiO_2$ was prepared in a similar procedure, as a conventional example of lead borosilicate glass. The glass transition point (Tg) of the thus-obtained glass is shown in the following Table 21. Herein, the glass transition point (Tg) was determined using a thermal analysis apparatus.

Then, the lead borosilicate-type glass frit was weighed in a given amount (5.0% by weight), which was followed by milling in the above-mentioned Ag paste (65% by weight of Ag powder was dissolved into 30% by weight of a vehicle, in which ethyl cellulose is dissolved into butyl carbitol) to produce an electrode material for a zinc oxide varistor.

In order to evaluate the electrode material for a zinc oxide varistor, which was produced as above, a zinc oxide varistor sintered-body (varistor element 1) (a disk-shape being 13 mm in diameter and 1.5 mm in thickness) was provided, said sintered-body consisting of bismuth oxide ($Bi_2O_3$), cobalt oxide ($Co_3O_4$), manganese oxide ($MnO_2$), nickel oxide (NiO), antimony oxide ($Sb_2O_3$) and chromium oxide ($Cr_2O_3$) respectively in 0.5 mole %, and 0.005 mole % of $Al_2O_3$, the rest being zinc oxide (ZnO). On both surfaces of said sintered-body, an electrode material for zinc oxide varistor was screen-printed to be 10 mm in diameter, and then baked at 750° C. for 10 min. to form electrodes 2, which was followed by soldering lead wires 3 thereon and subsequently molding with insulative resin 4 to obtain a sample.

With respect to the thus-obtained samples, voltage ratio (voltage nonlinearity) ($V_{1\ mA}/V_{10\ \mu A}$), limit voltage ratio characteristic ($V_{50\ A}/V_{1\ mA}$) and, surge current resistance characteristic are shown in the following Table 22. Herein, the voltage ratio ($V_{1\ mA}/V_{10\ \mu A}$) and limit voltage ratio ($V_{50\ A}/V_{1\ mA}$) was obtained through determination using a direct current constant current electric source. Further, the surge current resistance characteristic was obtained by determining a variation ratio of varistor voltage ($V_{1\ mA}$) occurring when an impact current of 8/20 μS standard waveform and 5000 A crest value was applied two times in the same direction. The number of samples was 10 per lot.

TABLE 21

| Designation of glass | Component ratio (wt. %) PbO | $B_2O_3$ | $SiO_2$ | $TeO_2$ | Tg (°C.) |
|---|---|---|---|---|---|
| A* | 70.0 | 15.0 | 15.0 | 0 | 405 |
| B | 69.9 | 15.0 | 15.0 | 0.1 | 405 |
| C | 60.0 | 15.0 | 15.0 | 10.0 | 400 |
| D | 50.0 | 15.0 | 15.0 | 20.0 | 405 |
| E | 40.0 | 15.0 | 15.0 | 30.0 | 420 |
| F* | 40.0 | 10.0 | 15.0 | 35.0 | 425 |
| G* | 30.0 | 30.0 | 30.0 | 10.0 | 580 |
| H | 79.9 | 10.0 | 10.0 | 0.1 | 360 |
| I* | 84.9 | 10.0 | 5.0 | 0.1 | 345 |
| J* | 70.0 | 0 | 20.0 | 10.0 | 470 |
| K | 65.0 | 5.0 | 20.0 | 10.0 | 485 |
| L* | 50.0 | 5.0 | 35.0 | 10.0 | 560 |
| M* | 70.0 | 20.0 | 0 | 10.0 | 460 |
| N* | 50.0 | 35.0 | 5.0 | 10.0 | 545 |

*are comparative examination examples which are outside of the present invention.

TABLE 22

| Sample No. | Designation of glass | $V_{1\ mA}/V_{10\ \mu A}$ | $V_{50\ A}/V_{1\ mA}$ | Surge current resistance characteristic $\Delta V_{1\ mA}$ (%) Direction same as that of current | Direction reverse to that of current |
|---|---|---|---|---|---|
| 1 | A* | 1.42 | 1.67 | −18.4 | −27.5 |
| 2 | B | 1.25 | 1.53 | −16.4 | −24.8 |
| 3 | C | 1.06 | 1.48 | −4.2 | −7.3 |
| 4 | D | 1.20 | 1.47 | −5.1 | −8.9 |
| 5 | E | 1.23 | 1.47 | −7.5 | −11.6 |
| 6 | F* | 1.35 | 1.68 | −19.3 | −26.9 |
| 7 | G* | 1.37 | 1.57 | −18.4 | −27.1 |
| 8 | H | 1.26 | 1.48 | −8.9 | −10.2 |
| 9 | I* | 1.29 | 1.51 | −12.8 | −21.7 |
| 10 | J* | 1.36 | 1.49 | −10.3 | −18.5 |
| 11 | K | 1.22 | 1.45 | −9.7 | −18.0 |
| 12 | L* | 1.33 | 1.46 | −22.2 | −34.5 |
| 13 | M* | 1.25 | 1.47 | −17.0 | −23.8 |
| 14 | N* | 1.22 | 1.50 | −19.6 | −41.3 |

*are comparative examination examples which are outside of the present invention.

At first there is contemplated from Tables 21 and 22 the influence on voltage ratio (voltage nonlinearity), limit voltage ratio characteristic and surge current resistance characteristic by a $TeO_2$ content contained in a lead borosilicate-type glass in an electrode material for a zinc oxide varistor. As shown in Sample No. 6 in Table 22, a composition system having a $TeO_2$ content of 0.1% by weight or more are improved in voltage ratio (voltage nonlinearity) but that having a $TeO_2$ content of more than 30.0% by weight will be deteriorated in limit voltage ratio characteristic and surge current resistance characteristic. Accordingly, it is a necessary condition that lead borosilicate-type glass in an electrode material for zinc oxide varistor is a composition system containing at least 0.1–30.0% by weight of $TeO_2$.

On the other hand, since surge current resistance characteristic is affected by contents of PbO, $B_2O_3$ and $SiO_2$ in addition to the $TeO_2$ content, these compositions are required to be considered.

Therefore, influence on limit voltage ratio characteristic and surge current resistance characteristic by constituents of a lead borosilicate type glass contained in an electrode material will be considered on the basis of Tables 21 and 22.

Glass of a composition system having PbO content less than 40.0% by weight such as Glass G in Table 21 has a higher glass transition point Tg and too low a fluidity of glass, which result in a deteriorated solder-wetness of the glass. Contrarily, glass of a composition system having a PbO content in excess of 80.0% by weight, such as Glass I in Table 21 has a lower glass transition point Tg and too great a fluidity of the glass, which result in a lower adhesion strength of electrode. Therefore, this lacks reliability. In a composition system having a $B_2O_3$ content of less than 5.0% by weight, as shown in Sample No. 10 in Table 22, voltage ratio (voltage nonlinearity) is deteriorated. On the other hand, in a composition system having a $B_2O_3$ content in excess of 30.0% by weight, as shown in Sample No. 14 in Table 22, surge current resistance characteristic is also deteriorated. In a composition system having $SiO_2$ content of less than 5.0% by weight, as shown in Sample No. 13 in Table 22, surge current resistance characteristic is also deteriorated. In a composition system having a $SiO_2$ content in excess of 30.0% by weight, as shown in Sample No. 12 in Table 22, surge current resistance characteristic will also become inferior.

From the above results, it is understandable that composition of glass components of an electrode material for a zinc oxide varistor is optimum to be in a range of 40.0–80.0% by weight of PbO, 5.0–30.0% by weight of $B_2O_3$, 5.0–30.0% by weight of $SiO_2$ and 0.1–30.0% by weight of $TeO_2$.

(Working Example 12)

Hereinunder, detailed explanation is made for the 12th working example of the present invention.

According to the composition list of the following Table 23, PbO, $B_2O_3$, $SiO_2$, $TeO_2$, $Al_2O_3$, $In_2O_3$, $Ga_2O_3$ and $GeO_2$ were each weighed in a given amount, and then glass was produced in the similar procedure as in the above working examples. The characteristics of said glass are shown in Table 23.

Then, this glass was used to produce an electrode material for a zinc oxide varistor in a similar manner to those of the above working examples. Said material was applied onto the varistor element 1 used in the above working examples to form electrodes 2. Evaluation was made in a similar manner. The results are shown in Table 24.

TABLE 23

| Designation of glass | Component ratio (wt. %) PbO | $B_2O_3$ | $SiO_2$ | $TeO_2$ | $Al_2O_3$ | $In_2O_3$ | $Ga_2O_3$ | $GeO_2$ | Tg (°C.) |
|---|---|---|---|---|---|---|---|---|---|
| C | 60.0 | 15.0 | 15.0 | 10.0 | 0 | 0 | 0 | 0 | 400 |
| O | 59.9999 | 15.0 | 15.0 | 10.0 | 0.0001 | 0 | 0 | 0 | 400 |
| P | 59.9 | 15.0 | 15.0 | 10.0 | 0 | 0 | 0 | 0 | 395 |
| Q | 59.9 | 15.0 | 15.0 | 10.0 | 0.05 | 0.05 | 0 | 0 | 395 |
| R | 59.9 | 15.0 | 15.0 | 10.0 | 0 | 0.1 | 0 | 0 | 390 |
| S | 59.9 | 15.0 | 15.0 | 10.0 | 0 | 0 | 0.1 | 0 | 400 |
| T | 59.9 | 15.0 | 15.0 | 10.0 | 0 | 0 | 0 | 0.1 | 395 |
| U* | 58.5 | 15.0 | 15.0 | 10.0 | 1.5 | 0 | 0 | 0 | 400 |
| V* | 58.5 | 15.0 | 15.0 | 10.0 | 0.05 | 0.05 | 0.05 | 0 | 395 |

*are comparative examination examples which are outside of the present invention.

TABLE 24

| Sample No. | Designation of glass | $V_{1\,mA}/V_{10\,\mu A}$ | $V_{50\,A}/V_{1\,mA}$ | Surge current resistance characteristic $\Delta V_{1\,mA}$ (%) Direction same as that of current | Direction reverse to that of current |
|---|---|---|---|---|---|
| 3 | C | 1.06 | 1.48 | −4.2 | −7.3 |
| 15 | O | 1.06 | 1.40 | −4.0 | −7.5 |
| 16 | P | 1.07 | 1.34 | −4.5 | −8.2 |
| 17 | Q | 1.07 | 1.35 | −5.3 | −8.7 |
| 18 | R | 1.10 | 1.33 | −6.8 | −10.0 |
| 19 | S | 1.08 | 1.36 | −5.9 | −11.8 |
| 20 | T | 1.09 | 1.35 | −3.7 | −7.1 |

TABLE 24-continued

| Sample No. | Designation of glass | $V_{1\ mA}/V_{10\ \mu A}$ | $V_{50\ A}/V_{1\ mA}$ | Surge current resistance characteristic $\Delta V_{1\ mA}$ (%) Direction same as that of current | Direction reverse to that of current |
|---|---|---|---|---|---|
| 21 | U* | 1.37 | 1.38 | −16.3 | −24.9 |
| 22 | V* | 1.41 | 1.37 | −17.2 | −30.3 |

*are comparative examination examples which are outside of the present invention.

At first, there is contemplated from Tables 23 and 24 the influence on voltage ratio (voltage nonlinearity), limit voltage ratio characteristic and surge current resistance characteristic by $Al_2O_3$, $In_2O_3$, $Ga_2O_3$ and $GeO_2$ contents contained in a lead borosilicate-type glass frit in an electrode material for zinc oxide varistor. As shown in Sample Nos. 15–20 in Table 24, a composition system containing $1.0\times10^{-4}$% by weight of at least one chemical element selected out of $Al_2O_3$, $In_2O_3$, $Ga_2O_3$ and $GeO_2$ is improved in limit voltage ratio characteristic. However, as in Sample Nos. 21 and 22 in Table 24, a composition system in which amounts to be added of the above chemical elements exceed 1.0% by weight in the total becomes deteriorated in voltage ratio (voltage nonlinearity) and surge current resistance characteristic.

Accordingly, it is a necessary condition that lead borosilicate glass in an electrode material for zinc oxide varistor is a composition system containing $1.0\times10^{-4}$–1.0% by weight of at least one chemical element selected out of $Al_2O_3$, $In_2O_3$, $Ga_2O_3$ and $GeO_2$.

On the other hand, surge current resistance characteristic is affected by contents of PbO, $B_2O_3$, $SiO_2$ and $TeO_2$ in addition to contents of $Al_2O_3$, $In_2O_3$, $Ga_2O_3$ and $GeO_2$.

For similar reasons in the above working examples, it is understandable that composition of glass components of electrode material for zinc oxide varistor is optimum in a range of 40.0–80.0% by weight of PbO, 5.0– 30.0% by weight of $B_2O_3$, 5.0–30.0% by weight of $SiO_2$, 0.1–30.0% by weight of $TeO_2$ and $1.0\times10^{-4}$–1.0% by weight of at least one chemical element selected from $Al_2O_3$, $In_2O_3$, $Ga_2O_3$ and $GeO_2$.

Further, as shown in Sample No. 17 in Table 17, it was confirmed that even when a combination of the oxides such as $Al_2O_3$, $In_2O_3$, $Ga_2O_3$, $GeO_2$ and the like, such results as above could have been obtained.

Although lead oxide, boron oxide, silicon oxide tellurium oxide, aluminium oxide and indium oxide were used, as material of lead borosilicate-type glass, in the forms of PbO, $B_2O_3$, $SiO_2$, $TeO_2$, $Al_2O_3$ and $In_2O_3$, respectively in the present working example, it was confirmed that the use of other oxide forms could have also acquired equal physical properties. Further, the present working example referred only to the case in which lead borosilicate-type glass content in electrode material for zinc oxide varistor was 5.0% by weight. However, so far as said content is within 1.0–30.0% by weight, no change is seen in the effect of the present invention. Furthermore, a zinc oxide varistor of a system consisting of ZnO, $Bi_2O_3$, $Co_3O_4$, $MnO_2$, NiO, $Sb_2O_3$, $Cr_2O_3$ and $Al_2O_3$ was used as a sintered-body (varistor element 1) for evaluation. However, even when the electrode material for zinc oxide varistor according to the present invention is applied to a zinc oxide varistor containing $Pr_6O_{11}$, CaO, BaO, MgO, $K_2O$, $SiO_2$, etc., no change is seen in effect.

Next, a lead borosilicate-type glass containing lanthanoid-series oxides was fritted in the same manner as in the above working examples. This glass frit was milled into the Ag paste same as in the above working examples, which was followed by applying onto a fired varistor element 1 to form electrodes 2. Hereinunder explanation is given thereon.

The lead borosilicate-type glass in this case contains lanthanoid-series oxide (0.1–30.0% by weight), boron oxide (5.0–30.0% by weight), silicon oxide (5.0–30.0% by weight) and lead oxide (40.0–80.0% by weight).

The following Tables 25 and 26 concern those having used lanthanum oxide ($LaO_3$), in which its content of 0.1% by weight or more will become better in voltage ratio (voltage nonlinearity). Further, when such a content is more than 30% by weight, glass transition point Tg becomes higher and the diffusion into varistor element 1 becomes difficult, thereby rendering surge current resistance characteristic to be deteriorated.

Further, when an amount of boron oxide is less than 5.0% by weight, voltage ratio (voltage nonlinearity) will become inferior, and when it is more than 30%, surge current resistance characteristic will become deteriorated.

Furthermore, when silicon oxide content is less than 5.0% by weight, surge current resistance characteristic will become inferior, and when it is more than 30.0% by weight, voltage ratio (voltage nonlinearity) and surge current resistance characteristic will become deteriorated.

TABLE 25

| Designation of glass | Component ratio (wt. %) PbO | $B_2O_3$ | $SiO_2$ | $La_2O_3$ | Tg (°C.) |
|---|---|---|---|---|---|
| A* | 70.0 | 15.0 | 15.0 | 0 | 405 |
| B | 69.9 | 15.0 | 15.0 | 0.1 | 405 |
| C | 67.5 | 15.0 | 15.0 | 2.5 | 415 |
| D | 65.0 | 15.0 | 15.0 | 5.0 | 420 |
| E | 55.0 | 15.0 | 20.0 | 10.0 | 460 |
| F | 40.0 | 10.0 | 20.0 | 30.0 | 518 |
| G* | 32.5 | 15.0 | 20.0 | 32.5 | 545 |
| H | 72.0 | 3.0 | 20.0 | 5.0 | 415 |
| I | 70.0 | 5.0 | 20.0 | 5.0 | 420 |
| J | 57.5 | 30.0 | 10.0 | 2.5 | 440 |
| K* | 52.5 | 35.0 | 10.0 | 2.5 | 453 |
| L* | 69.5 | 25.0 | 3.0 | 2.5 | 420 |
| M | 72.5 | 20.0 | 5.0 | 2.5 | 422 |
| N | 52.5 | 15.0 | 30.0 | 2.5 | 460 |
| O* | 50.0 | 15.0 | 32.5 | 2.5 | 465 |

*are comparative examination examples which are outside of the present invention.

TABLE 26

| Sample No. | Designation of glass | $V_{1\ mA}/V_{10\ \mu A}$ | Limit voltage ratio $V_{50\ A}/V_{1\ mA}$ | Surge current resistance characteristic $\Delta V_{1\ mA}$ (%) Direction same as that of current | Direction reverse to that of current |
|---|---|---|---|---|---|
| 1 | A* | 1.33 | 1.57 | −18.4 | −27.5 |
| 2 | B | 1.20 | 1.57 | −18.0 | −25.1 |
| 3 | C | 1.08 | 1.47 | −5.1 | −10.6 |
| 4 | D | 1.06 | 1.47 | −7.3 | −12.4 |
| 5 | E | 1.07 | 1.46 | −8.9 | −17.9 |
| 6 | F | 1.10 | 1.50 | −10.4 | −22.5 |
| 7 | G* | 1.27 | 1.55 | −18.9 | −36.2 |
| 8 | H* | 1.33 | 1.50 | −15.5 | −18.6 |
| 9 | I | 1.15 | 1.52 | −11.2 | −19.7 |
| 10 | J | 1.10 | 1.50 | −10.9 | −23.6 |
| 11 | K* | 1.11 | 1.53 | −21.4 | −32.8 |
| 12 | L | 1.15 | 1.50 | −19.8 | −38.3 |
| 13 | M | 1.17 | 1.51 | −10.7 | −23.7 |
| 14 | N | 1.22 | 1.50 | −16.6 | −24.0 |
| 15 | O* | 1.25 | 1.50 | −24.8 | −41.6 |

*are comparative examination examples which are outside of the present invention.

Next, characteristics are shown with respect to the cases having used therein the other oxides, in place of lanthanum oxide: cerium oxide in Tables 27 and 28, praseodium oxide also in Tables 29 and 30, neodymium oxide further in Tables 31 and 32, sammarium oxide in Tables 33 and 34, europium oxide in tables 35 and 36, gadolinium oxide in Tables 37 and 38, terbium oxide in Tables 39 and 40, dysprosium oxide in Tables 41 and 42, holmium oxide in Tables 43 and 44, erbium oxide in Tables 45 and 46, thulium oxide in Tables 47 and 48, yitterbium oxide in Tables 49 and 50, and lutetium oxide in Tables 51 and 52.

In all the above cases, voltage ratio (voltage nonlinearity) becomes better, if each lanthanoid-series oxide is contained in an amount of 0.1% by weight or more. Further, if it is more than 30% by weight, surge current resistance characteristic will be deteriorated.

TABLE 27

| Designation of glass | Component ratio (wt. %) PbO | $B_2O_3$ | $SiO_2$ | $CeO_2$ | Tg (°C.) |
|---|---|---|---|---|---|
| A* | 70.0 | 15.0 | 15.0 | 0 | 405 |
| B | 69.9 | 15.0 | 15.0 | 0.1 | 405 |
| C | 67.5 | 15.0 | 15.0 | 2.5 | 415 |
| D | 65.0 | 15.0 | 15.0 | 5.0 | 420 |
| E | 55.0 | 15.0 | 20.0 | 10.0 | 465 |
| F | 40.0 | 10.0 | 20.0 | 30.0 | 515 |
| G* | 32.5 | 15.0 | 20.0 | 32.5 | 540 |
| H* | 72.0 | 3.0 | 20.0 | 5.0 | 412 |
| I | 70.0 | 5.0 | 20.0 | 5.0 | 417 |
| J | 57.5 | 30.0 | 10.0 | 2.5 | 435 |
| K* | 52.5 | 35.0 | 10.0 | 2.5 | 455 |
| L* | 69.5 | 25.0 | 3.0 | 2.5 | 420 |
| M | 72.5 | 20.0 | 5.0 | 2.5 | 425 |
| N | 52.5 | 15.0 | 30.0 | 2.5 | 460 |
| O* | 50.0 | 15.0 | 32.5 | 2.5 | 467 |

*are comparative examination examples which are outside of the present invention.

TABLE 28

| Sample No. | Designation of glass | $V_{1\ mA}/V_{10\ \mu A}$ | Limit voltage ratio $V_{50\ A}/V_{1\ mA}$ | Surge current resistance characteristic $\Delta V_{1\ mA}$ (%) Direction same as that of current | Direction reverse to that of current |
|---|---|---|---|---|---|
| 1 | A* | 1.33 | 1.57 | −18.4 | −27.5 |
| 2 | B | 1.21 | 1.56 | −17.9 | −24.8 |
| 3 | C | 1.08 | 1.46 | −4.8 | −9.2 |
| 4 | D | 1.05 | 1.47 | −6.9 | −11.0 |
| 5 | E | 1.08 | 1.47 | −8.8 | −17.4 |
| 6 | F | 1.11 | 1.49 | −9.7 | −21.7 |
| 7 | G* | 1.27 | 1.53 | −20.3 | −36.0 |
| 8 | H* | 1.32 | 1.50 | −14.8 | −20.7 |
| 9 | I | 1.14 | 1.52 | −11.3 | −18.5 |
| 10 | J | 1.11 | 1.50 | −10.4 | −21.1 |
| 11 | K* | 1.10 | 1.51 | −19.7 | −32.6 |
| 12 | L* | 1.16 | 1.50 | −19.3 | −36.3 |
| 13 | M | 1.17 | 1.50 | −10.9 | −20.8 |
| 14 | N | 1.23 | 1.51 | −15.1 | −21.3 |

TABLE 28-continued

| Sample No. | Designation of glass | $V_{1\ mA}/V_{10\ \mu A}$ | Limit voltage ratio $V_{50\ A}/V_{1\ mA}$ | Surge current resistance characteristic $\Delta V_{1\ mA}$ (%) Direction same as that of current | Direction reverse to that of current |
|---|---|---|---|---|---|
| 15 | O* | 1.25 | 1.49 | −25.1 | −42.1 |

*are comparative examination examples which are outside of the present invention.

TABLE 29

| Designation of glass | Component ratio (wt. %) PbO | $B_2O_3$ | $SiO_2$ | $Pr_6O_{11}$ | Tg (°C.) |
|---|---|---|---|---|---|
| A* | 70.0 | 15.0 | 15.0 | 0 | 405 |
| B | 69.9 | 15.0 | 15.0 | 0.1 | 405 |
| C | 67.5 | 15.0 | 15.0 | 2.5 | 417 |
| D | 65.0 | 15.0 | 15.0 | 5.0 | 422 |
| E | 55.0 | 15.0 | 20.0 | 10.0 | 460 |
| F | 40.0 | 10.0 | 20.0 | 30.0 | 515 |
| G* | 32.5 | 15.0 | 20.0 | 32.5 | 547 |
| H* | 72.0 | 3.0 | 20.0 | 5.0 | 420 |
| I | 70.0 | 5.0 | 20.0 | 5.0 | 418 |
| J | 57.5 | 30.0 | 10.0 | 2.5 | 440 |
| K* | 52.5 | 35.0 | 10.0 | 2.5 | 445 |
| L* | 69.5 | 25.0 | 3.0 | 2.5 | 425 |
| M | 72.5 | 20.0 | 5.0 | 2.5 | 427 |
| N | 52.5 | 15.0 | 30.0 | 2.5 | 460 |
| O* | 50.0 | 15.0 | 32.5 | 2.5 | 465 |

*are comparative examination examples which are outside of the present invention.

TABLE 31-continued

| Designation of glass | Component ratio (wt. %) PbO | $B_2O_3$ | $SiO_2$ | $Nd_2O_3$ | Tg (°C.) |
|---|---|---|---|---|---|
| F | 40.0 | 10.0 | 20.0 | 30.0 | 520 |
| G* | 32.5 | 15.0 | 20.0 | 32.5 | 550 |
| H* | 72.0 | 3.0 | 20.0 | 5.0 | 420 |
| I | 70.0 | 5.0 | 20.0 | 5.0 | 415 |
| J | 57.5 | 30.0 | 10.0 | 2.5 | 440 |
| K* | 52.5 | 35.0 | 10.0 | 2.5 | 457 |
| L* | 69.5 | 25.0 | 3.0 | 2.5 | 423 |
| M | 72.5 | 20.0 | 5.0 | 2.5 | 430 |
| N | 52.5 | 15.0 | 30.0 | 2.5 | 465 |
| O* | 50.0 | 15.0 | 32.5 | 2.5 | 470 |

*are comparative examination examples which are outside of the present invention.

TABLE 30

| Sample No. | Designation of glass | $V_{1\ mA}/V_{10\ \mu A}$ | Limit voltage ratio $V_{50\ A}/V_{1\ mA}$ | Surge current resistance characteristic $\Delta V_{1\ mA}$ (%) Direction same as that of current | Direction reverse to that of current |
|---|---|---|---|---|---|
| 1 | A* | 1.33 | 1.57 | −18.4 | −27.5 |
| 2 | B | 1.22 | 1.59 | −18.0 | −26.2 |
| 3 | C | 1.09 | 1.47 | −5.6 | −10.8 |
| 4 | D | 1.07 | 1.46 | −7.8 | −12.7 |
| 5 | E | 1.10 | 1.46 | −9.5 | −18.5 |
| 6 | F | 1.12 | 1.48 | −11.2 | −21.9 |
| 7 | G* | 1.26 | 1.51 | −20.4 | −37.0 |
| 8 | H* | 1.35 | 1.49 | −16.8 | −19.2 |
| 9 | I | 1.16 | 1.50 | −11.3 | −20.2 |
| 10 | J | 1.12 | 1.50 | −11.0 | −24.8 |
| 11 | K* | 1.11 | 1.52 | −21.1 | −33.1 |
| 12 | L* | 1.15 | 1.51 | −19.6 | −40.3 |
| 13 | M | 1.16 | 1.50 | −11.0 | −24.9 |
| 14 | N | 1.23 | 1.50 | −16.2 | −22.6 |
| 15 | O* | 1.28 | 1.51 | −25.3 | −42.8 |

*are comparative examination examples which are outside of the present invention.

TABLE 31

| Designation of glass | Component ratio (wt. %) PbO | $B_2O_3$ | $SiO_2$ | $Nd_2O_3$ | Tg (°C.) |
|---|---|---|---|---|---|
| A* | 70.0 | 15.0 | 15.0 | 0 | 405 |
| B | 69.9 | 15.0 | 15.0 | 0.1 | 406 |
| C | 67.5 | 15.0 | 15.0 | 2.5 | 417 |
| D | 65.0 | 15.0 | 15.0 | 5.0 | 420 |
| E | 55.0 | 15.0 | 20.0 | 10.0 | 470 |

TABLE 32

| Sample No. | Designation of glass | $V_{1\ mA}/V_{10\ \mu A}$ | Limit voltage ratio $V_{50\ A}/V_{1\ mA}$ | Surge current resistance characteristic $\Delta V_{1\ mA}$ (%) Direction same as that of current | Direction reverse to that of current |
|---|---|---|---|---|---|
| 1 | A* | 1.33 | 1.57 | −18.4 | −27.5 |
| 2 | B | 1.19 | 1.55 | −18.1 | −26.4 |
| 3 | C | 1.08 | 1.46 | −6.3 | −11.2 |
| 4 | D | 1.06 | 1.47 | −8.0 | −12.9 |
| 5 | E | 1.06 | 1.46 | −10.7 | −17.1 |
| 6 | F | 1.08 | 1.50 | −12.4 | −21.6 |
| 7 | G* | 1.29 | 1.53 | −20.3 | −37.3 |
| 8 | H* | 1.31 | 1.50 | −16.3 | −19.2 |
| 9 | I | 1.16 | 1.51 | −11.4 | −19.4 |
| 10 | J | 1.10 | 1.50 | −11.8 | −23.0 |
| 11 | K* | 1.12 | 1.53 | −20.4 | −33.7 |
| 12 | L* | 1.14 | 1.49 | −19.8 | −38.5 |
| 13 | M | 1.17 | 1.50 | −11.2 | −22.9 |
| 14 | N | 1.23 | 1.50 | −15.3 | −23.8 |
| 15 | O* | 1.26 | 1.50 | −25.0 | −42.4 |

*are comparative examination examples which are outside of the present invention.

TABLE 33

| Designation of glass | Component ratio (wt. %) PbO | $B_2O_3$ | $SiO_2$ | $Sm_2O_3$ | Tg (°C.) |
|---|---|---|---|---|---|
| A* | 70.0 | 15.0 | 15.0 | 0 | 405 |
| B | 69.9 | 15.0 | 15.0 | 0.1 | 405 |
| C | 67.5 | 15.0 | 15.0 | 2.5 | 415 |
| D | 65.0 | 15.0 | 15.0 | 5.0 | 422 |
| E | 55.0 | 15.0 | 20.0 | 10.0 | 465 |
| F | 40.0 | 10.0 | 20.0 | 30.0 | 525 |
| G* | 32.5 | 15.0 | 20.0 | 32.5 | 553 |
| H* | 72.0 | 3.0 | 20.0 | 5.0 | 413 |
| I | 70.0 | 5.0 | 20.0 | 5.0 | 415 |
| J | 57.5 | 30.0 | 10.0 | 2.5 | 442 |
| K* | 52.5 | 35.0 | 10.0 | 2.5 | 458 |
| L* | 69.5 | 25.0 | 3.0 | 2.5 | 425 |
| M | 72.5 | 20.0 | 5.0 | 2.5 | 430 |
| N | 52.5 | 15.0 | 30.0 | 2.5 | 460 |
| O* | 50.0 | 15.0 | 32.5 | 2.5 | 465 |

*are comparative examination examples which are outside of the present invention.

TABLE 35

| Designation of glass | Component ratio (wt. %) PbO | $B_2O_3$ | $SiO_2$ | $Eu_2O_3$ | Tg (°C.) |
|---|---|---|---|---|---|
| A* | 70.0 | 15.0 | 15.0 | 0 | 405 |
| B | 69.9 | 15.0 | 15.0 | 0.1 | 407 |
| C | 55.0 | 15.0 | 20.0 | 10.0 | 470 |
| D | 40.0 | 10.0 | 20.0 | 30.0 | 523 |
| E* | 32.5 | 15.0 | 20.0 | 32.5 | 550 |

*are comparative examination examples which are outside of the present invention.

TABLE 34

| Sample No. | Designation of glass | $V_{1\ mA}/V_{10\ \mu A}$ | Limit voltage ratio $V_{50\ A}/V_{1\ mA}$ | Surge current resistance characteristic $\Delta V_{1\ mA}$ (%) Direction same as that of current | Direction reverse to that of current |
|---|---|---|---|---|---|
| 1 | A* | 1.33 | 1.57 | −18.4 | −27.5 |
| 2 | B | 1.20 | 1.56 | −17.9 | −26.1 |
| 3 | C | 1.07 | 1.47 | −5.9 | −11.3 |
| 4 | D | 1.05 | 1.48 | −9.4 | −13.1 |
| 5 | E | 1.07 | 1.47 | −9.8 | −17.8 |
| 6 | F | 1.09 | 1.50 | −12.6 | −22.0 |
| 7 | G* | 1.28 | 1.54 | −21.0 | −38.5 |
| 8 | H* | 1.33 | 1.50 | −17.5 | −19.9 |
| 9 | I | 1.15 | 1.52 | −10.6 | −20.8 |
| 10 | J | 1.09 | 1.50 | −11.9 | −25.2 |
| 11 | K* | 1.13 | 1.53 | −22.2 | −32.3 |
| 12 | L* | 1.15 | 1.50 | −20.2 | −41.8 |
| 13 | M | 1.15 | 1.50 | −11.1 | −23.9 |
| 14 | N | 1.22 | 1.51 | −16.4 | −21.8 |
| 15 | O* | 1.25 | 1.49 | −25.6 | −42.6 |

*are comparative examination examples which are outside of the present invention.

TABLE 36

| Sample No. | Designation of glass | $V_{1\ mA}/V_{10\ \mu A}$ | Limit voltage ratio $V_{50\ A}/V_{1\ mA}$ | Surge current resistance characteristic $\Delta V_{1\ mA}$ (%) Direction same as that of current | Surge current resistance characteristic $\Delta V_{1\ mA}$ (%) Direction reverse to that of current |
|---|---|---|---|---|---|
| 1 | A* | 1.33 | 1.57 | −18.4 | −27.5 |
| 2 | B | 1.21 | 1.57 | −18.0 | −26.5 |
| 3 | C | 1.08 | 1.47 | −9.7 | −18.2 |
| 4 | D | 1.10 | 1.49 | −11.9 | −21.8 |
| 5 | E* | 1.30 | 1.52 | −20.3 | −39.7 |

*are comparative examination examples which are outside of the present invention.

TABLE 37

| Designation of glass | Component ratio (wt. %) PbO | $B_2O_3$ | $SiO_2$ | $Gd_2O_3$ | Tg (°C.) |
|---|---|---|---|---|---|
| A* | 70.0 | 15.0 | 15.0 | 0 | 405 |
| B | 69.9 | 15.0 | 15.0 | 0.1 | 407 |
| C | 55.0 | 15.0 | 20.0 | 10.0 | 470 |
| D | 40.0 | 10.0 | 20.0 | 30.0 | 523 |
| E* | 32.5 | 15.0 | 20.0 | 32.5 | 550 |

*are comparative examination examples which are outside of the present invention.

TABLE 38

| Sample No. | Designation of glass | $V_{1\ mA}/V_{10\ \mu A}$ | Limit voltage ratio $V_{50\ A}/V_{1\ mA}$ | Surge current resistance characteristic $\Delta V_{1\ mA}$ (%) Direction same as that of current | Surge current resistance characteristic $\Delta V_{1\ mA}$ (%) Direction reverse to that of current |
|---|---|---|---|---|---|
| 1 | A* | 1.33 | 1.57 | −18.4 | −27.5 |
| 2 | B | 1.22 | 1.56 | −17.9 | −26.1 |
| 3 | C | 1.08 | 1.47 | −9.3 | −18.7 |
| 4 | D | 1.10 | 1.48 | −12.2 | −22.0 |
| 5 | E* | 1.30 | 1.51 | −20.8 | −39.5 |

*are comparative examination examples which are outside of the present invention.

TABLE 39

| Designation of glass | Component ratio (wt. %) PbO | $B_2O_3$ | $SiO_2$ | $Tb_4O_7$ | Tg (°C.) |
|---|---|---|---|---|---|
| A* | 70.0 | 15.0 | 15.0 | 0 | 405 |
| B | 69.9 | 15.0 | 15.0 | 0.1 | 405 |
| C | 55.0 | 15.0 | 20.0 | 10.0 | 475 |
| D | 40.0 | 10.0 | 20.0 | 30.0 | 520 |
| E* | 32.5 | 15.0 | 20.0 | 32.5 | 550 |

*are comparative examination examples which are outside of the present invention.

TABLE 40

| Sample No. | Designation of glass | $V_{1\ mA}/V_{10\ \mu A}$ | Limit voltage ratio $V_{50\ A}/V_{1\ mA}$ | Surge current resistance characteristic $\Delta V_{1\ mA}$ (%) Direction same as that of current | Surge current resistance characteristic $\Delta V_{1\ mA}$ (%) Direction reverse to that of current |
|---|---|---|---|---|---|
| 1 | A* | 1.33 | 1.57 | −18.4 | −27.5 |
| 2 | B | 1.20 | 1.55 | −18.1 | −26.3 |
| 3 | C | 1.09 | 1.48 | −9.9 | −19.1 |
| 4 | D | 1.09 | 1.49 | −12.0 | −22.6 |
| 5 | E* | 1.31 | 1.50 | −21.1 | −40.4 |

*are comparative examination examples which are outside of the present invention.

TABLE 41

| Designation of glass | Component ratio (wt. %) PbO | $B_2O_3$ | $SiO_2$ | $Dy_2O_3$ | Tg (°C.) |
|---|---|---|---|---|---|
| A* | 70.0 | 15.0 | 15.0 | 0 | 405 |
| B | 69.9 | 15.0 | 15.0 | 0.1 | 405 |
| C | 55.0 | 15.0 | 20.0 | 10.0 | 472 |
| D | 40.0 | 10.0 | 20.0 | 30.0 | 528 |
| E* | 32.5 | 15.0 | 20.0 | 32.5 | 555 |

*are comparative examination examples which are outside of the present invention.

TABLE 42

| Sample No. | Designation of glass | $V_{1\ mA}/V_{10\ \mu A}$ | Limit voltage ratio $V_{50\ A}/V_{1\ mA}$ | Surge current resistance characteristic $\Delta V_{1\ mA}$ (%) Direction same as that of current | Surge current resistance characteristic $\Delta V_{1\ mA}$ (%) Direction reverse to that of current |
|---|---|---|---|---|---|
| 1 | A* | 1.33 | 1.57 | −18.4 | −27.5 |
| 2 | B | 1.22 | 1.57 | −17.8 | −26.1 |
| 3 | C | 1.09 | 1.48 | −9.2 | −19.3 |
| 4 | D | 1.10 | 1.49 | −11.8 | −22.5 |
| 5 | E* | 1.31 | 1.50 | −20.7 | −39.6 |

*are comparative examination examples which are outside of the present invention.

TABLE 43

| Designation of glass | Component ratio (wt. %) PbO | $B_2O_3$ | $SiO_2$ | $Ho_2O_3$ | Tg (°C.) |
|---|---|---|---|---|---|
| A* | 70.0 | 15.0 | 15.0 | 0 | 405 |
| B | 69.9 | 15.0 | 15.0 | 0.1 | 407 |
| C | 55.0 | 15.0 | 20.0 | 10.0 | 475 |
| D | 40.0 | 10.0 | 20.0 | 30.0 | 532 |
| E* | 32.5 | 10.0 | 25.0 | 32.5 | 560 |

*are comparative examination examples which are outside of the present invention.

TABLE 44

| Sample No. | Designation of glass | $V_{1\,mA}/V_{10\,\mu A}$ | Limit voltage ratio $V_{50\,A}/V_{1\,mA}$ | Surge current resistance characteristic $\Delta V_{1\,mA}$ (%) Direction same as that of current | Surge current resistance characteristic $\Delta V_{1\,mA}$ (%) Direction reverse to that of current |
|---|---|---|---|---|---|
| 1 | A* | 1.33 | 1.57 | −18.4 | −27.5 |
| 2 | B | 1.22 | 1.57 | −18.1 | −25.4 |
| 3 | C | 1.09 | 1.47 | −10.3 | −19.7 |
| 4 | D | 1.10 | 1.48 | −11.7 | −22.9 |
| 5 | E* | 1.31 | 1.51 | −19.2 | −39.8 |

*are comparative examination examples which are outside of the present invention.

TABLE 45

| Designation of glass | Component ratio (wt. %) PbO | $B_2O_3$ | $SiO_2$ | $Er_2O_3$ | Tg (°C.) |
|---|---|---|---|---|---|
| A* | 70.0 | 15.0 | 15.0 | 0 | 405 |
| B | 69.9 | 15.0 | 15.0 | 0.1 | 408 |
| C | 55.0 | 15.0 | 20.0 | 10.0 | 477 |
| D | 40.0 | 10.0 | 20.0 | 30.0 | 530 |
| E* | 32.5 | 10.0 | 25.0 | 32.5 | 558 |

*are comparative examination examples which are outside of the present invention.

TABLE 46

| Sample No. | Designation of glass | $V_{1\,mA}/V_{10\,\mu A}$ | Limit voltage ratio $V_{50\,A}/V_{1\,mA}$ | Surge current resistance characteristic $\Delta V_{1\,mA}$ (%) Direction same as that of current | Surge current resistance characteristic $\Delta V_{1\,mA}$ (%) Direction reverse to that of current |
|---|---|---|---|---|---|
| 1 | A* | 1.33 | 1.57 | −18.4 | −27.5 |
| 2 | B | 1.24 | 1.56 | −18.0 | −25.7 |
| 3 | C | 1.10 | 1.50 | −11.2 | −19.3 |
| 4 | D | 1.15 | 1.50 | −11.8 | −22.4 |
| 5 | E* | 1.35 | 1.52 | −21.6 | −40.6 |

*are comparative examination examples which are outside of the present invention.

TABLE 47

| Designation of glass | Component ratio (wt. %) PbO | $B_2O_3$ | $SiO_2$ | $Tm_2O_3$ | Tg (°C.) |
|---|---|---|---|---|---|
| A* | 70.0 | 15.0 | 15.0 | 0 | 405 |
| B | 69.9 | 15.0 | 15.0 | 0.1 | 405 |
| C | 55.0 | 15.0 | 20.0 | 10.0 | 475 |
| D | 40.0 | 10.0 | 20.0 | 30.0 | 535 |
| E* | 32.5 | 10.0 | 25.0 | 32.5 | 565 |

*are comparative examination examples which are outside of the present invention.

TABLE 48

| Sample No. | Designation of glass | $V_{1\,mA}/V_{10\,\mu A}$ | Limit voltage ratio $V_{50\,A}/V_{1\,mA}$ | Surge current resistance characteristic $\Delta V_{1\,mA}$ (%) Direction same as that of current | Surge current resistance characteristic $\Delta V_{1\,mA}$ (%) Direction reverse to that of current |
|---|---|---|---|---|---|
| 1 | A* | 1.33 | 1.57 | −18.4 | −27.5 |
| 2 | B | 1.25 | 1.55 | −18.0 | −26.4 |
| 3 | C | 1.10 | 1.49 | −9.3 | −20.2 |
| 4 | D | 1.13 | 1.48 | −12.8 | −23.5 |
| 5 | E* | 1.33 | 1.51 | −21.5 | −41.1 |

*are comparative examination examples which are outside of the present invention.

TABLE 49

| Designation of glass | Component ratio (wt. %) PbO | $B_2O_3$ | $SiO_2$ | $Yb_2O_3$ | Tg (°C.) |
|---|---|---|---|---|---|
| A* | 70.0 | 15.0 | 15.0 | 0 | 405 |
| B | 69.9 | 15.0 | 15.0 | 0.1 | 405 |
| C | 55.0 | 15.0 | 20.0 | 10.0 | 475 |
| D | 40.0 | 10.0 | 20.0 | 30.0 | 530 |
| E* | 32.5 | 10.0 | 25.0 | 32.5 | 558 |

*are comparative examination examples which are outside of the present invention.

TABLE 50

| Sample No. | Designation of glass | $V_{1\,mA}/V_{10\,\mu A}$ | Limit voltage ratio $V_{50\,A}/V_{1\,mA}$ | Surge current resistance characteristic $\Delta V_{1\,mA}$ (%) Direction same as that of current | Surge current resistance characteristic $\Delta V_{1\,mA}$ (%) Direction reverse to that of current |
|---|---|---|---|---|---|
| 1 | A* | 1.33 | 1.57 | −18.4 | −27.5 |
| 2 | B | 1.24 | 1.56 | −18.2 | −27.1 |
| 3 | C | 1.11 | 1.50 | −10.4 | −19.8 |
| 4 | D | 1.12 | 1.48 | −13.0 | −24.1 |
| 5 | E* | 1.36 | 1.53 | −21.6 | −42.5 |

*are comparative examination examples which are outside of the present invention.

TABLE 51

| Designation of glass | Component ratio (wt. %) PbO | $B_2O_3$ | $SiO_2$ | $Lu_2O_3$ | Tg (°C.) |
|---|---|---|---|---|---|
| A* | 70.0 | 15.0 | 15.0 | 0 | 405 |
| B | 69.9 | 15.0 | 15.0 | 0.1 | 407 |
| C | 55.0 | 15.0 | 20.0 | 10.0 | 480 |
| D | 40.0 | 10.0 | 20.0 | 30.0 | 540 |
| E* | 32.5 | 10.0 | 25.0 | 32.5 | 565 |

*are comparative examination examples which are outside of the present invention.

TABLE 52

| Sample No. | Designation of glass | $V_{1\ mA}/V_{10\ \mu A}$ | Limit voltage ratio $V_{50\ A}/V_{1\ mA}$ | Surge current resistance characteristic $\Delta V_{1\ mA}$ (%) Direction same as that of current | Direction reverse to that of current |
|---|---|---|---|---|---|
| 1 | A* | 1.33 | 1.57 | −18.4 | −27.5 |
| 2 | B | 1.25 | 1.55 | −18.2 | −26.8 |
| 3 | C | 1.12 | 1.51 | −10.3 | −15.9 |
| 4 | D | 1.14 | 1.50 | −13.7 | −23.8 |
| 5 | E* | 1.36 | 1.51 | −21.0 | −43.5 |

*are comparative examination examples which are outside of the present invention.

The above working examples indicated the cases in which a lead borosilicate glass frit is milled into Ag-paste and then applied onto varistor element 1 to form electrodes 2, and upon baking of electrodes 2, chemical elements constituting said lead borosilicate glass frit are diffused into the varistor element 1. However, the present invention is not limited to said procedure. A similar effect concerning voltage ratio (voltage nonlinearity) has been obtained also by the following procedure, wherein prior to the formation of electrodes 2, a paste containing a lead borosilicate-type glass frit is applied onto a surface of a fired varistor element 1 and then the resultant is heated under such a state as it is, thereby allowing the chemical elements composing said lead borosilicate-type glass frit to penetrate into varistor element 1, and thereafter, a Ag-paste containing no lead borosilicate-type glass frit is used to form electrodes 2.

Further, an electrode material for forming electrodes 2 is not limited to Ag-paste, which may be replaced with pastes of the other metals such as Pd, etc.

INDUSTRIALLY AVAILABLE FIELD

As mentioned above, according to the present invention, there is diffused from a surface of a fired varistor element a lead borosilicate-type glass containing at least one metal oxide selected out of cobalt oxide, magnesium oxide, yttrium oxide, antimony oxide, manganese oxide, tellurium oxide, lanthanum oxide, cerium oxide, praseodium oxide, neodymium oxide, samarium oxide, europium oxide, gadolinium oxide, terbium oxide, dysprosium oxide, holmium oxide, erbium oxide, thulium oxide, ytterbium oxide and lutetium oxide.

Thus, when voltage nonlinearity is so improved, energy saving and efficiency improvement can be seen for various kinds of electronic instruments to be used owing to these being less leakage current.

We claim:

1. A zinc oxide varistor comprising a fired varistor element having opposite surfaces and at least two electrodes formed on said fired varistor element from an electrode paste, said fired varistor element comprising a lead borosilicate-type glass diffused into at least one of said surfaces of said fired varistor element during a heating operation employed to form said electrodes; said lead borosilicate-type glass comprising a mixture of lead borosilicate-type glass particulate material and at least one metal oxide selected from the group consisting of cobalt oxide, magnesium oxide, yttrium oxide, antimony oxide, manganese oxide, tellurium oxide, lanthanum oxide, cerium oxide, praseodium oxide, neodymium oxide, samarium oxide, europium oxide, gadolinium oxide, terbium oxide, dysprosium oxide, holmium oxide, erbium oxide, thulium oxide, ytterbium oxide and lutetium oxide;

wherein the glass particulate material and the at least one metal oxide are mixed to form said mixture, and then said mixture is fused and thereafter quenched;

with the provisos that if the at least one metal oxide comprises at least one member of the group consisting of cobalt oxide and manganese oxide, upon mixing the glass particulate material and the at least one metal oxide to form said mixture, said mixture contains 5.0–30% by weight of boron oxide, 5.0–30% by weight of silicon oxide, 40.0–80% by weight of lead oxide, and 0.1%–30.0% by weight of said at least one metal oxide.

2. The zinc oxide varistor of claim 1, wherein the lead borosilicate type glass is diffused from said electrode paste through the surface of said fired varistor element, into said fired varistor element.

3. The zinc oxide varistor according to claim 1, wherein said mixture contains 0.1–30% by weight cobalt oxide.

4. The zinc oxide varistor according to claim 1, wherein said mixture contains 0.1–30% by weight manganese oxide.

5. The zinc oxide varistor according to claim 1, wherein the glass particulate material and the at least one metal oxide are mixed to form said mixture, and then the mixture is fused and thereafter quenched, said mixture, upon forming, contains 5.0–30% by weight of boron oxide, 5.0–30% by weight of silicon oxide, 40.0–80% by weight of lead oxide and 0.1%–30.0% by weight of said at least one metal oxide.

6. The zinc oxide varistor according to claim 5, wherein said mixture contains 0.1–30% by weight magnesium oxide.

7. The zinc oxide varistor according to claim 5, wherein said mixture contains 0.1–30% by weight yttrium oxide.

8. The zinc oxide varistor according to claim 5, wherein said mixture contains 0.1–30% by weight antimony oxide.

9. The zinc oxide varistor according to claim 5, wherein said mixture contains 0.1–30% by weight tellurium oxide.

10. The zinc oxide varistor according to claim 5, wherein said mixture contains 0.1–30% by weight lanthanum oxide.

11. The zinc oxide varistor according to claim 5, wherein said mixture contains 0.1–30% by weight cerium oxide.

12. The zinc oxide varistor according to claim 5, wherein said mixture contains 0.1–30% by weight praseodium oxide.

13. The zinc oxide varistor according to claim 5, wherein said mixture contains 0.1–30% by weight neodymium oxide.

14. The zinc oxide varistor according to claim 5, wherein said mixture contains 0.1–30% by weight samarium oxide.

15. The zinc oxide varistor according to claim 5, wherein said mixture contains 0.1–30% by weight europium oxide.

16. The zinc oxide varistor according to claim 5, wherein said mixture contains 0.1–30% by weight gandolinum oxide.

17. The zinc oxide varistor according to claim 5, wherein said mixture contains 0.1–30% by weight terbium oxide.

18. The zinc oxide varistor according to claim 5, wherein said mixture contains 0.1–30% by weight dysprosium oxide.

19. The zinc oxide varistor according to claim 5, wherein said mixture contains 0.1–30% by weight holmium oxide.

20. The zinc oxide varistor according to claim 5, wherein said mixture contains 0.1–30% by weight erbium oxide.

21. The zinc oxide varistor according to claim 5, wherein said mixture contains 0.1–30% by weight thulium oxide.

22. The zinc oxide varistor according to claim 5, wherein said mixture contains 0.1–30% by weight ytterbium oxide.

23. The zinc oxide varistor according to claim 5, wherein said mixture contains 0.1–30% by weight lutetium oxide.

24. A zinc oxide varistor comprising a fired varistor element having opposite surfaces, and at least two electrodes formed on said fired varistor element from an electrode paste, said fired varistor element comprising a lead borosilicate-type glass diffused into at least one surface of said fired varistor element during a heating operation employed to form said electrodes; said lead borosilicate-type glass comprising a mixture of lead borosilicate-type glass particulate material and at least one first metal oxide selected from the group consisting of cobalt oxide, magnesium oxide, yttrium oxide, antimony oxide, manganese oxide, tellurium oxide, lanthanum oxide, cerium oxide, praseodium oxide, neodymium oxide, samarium oxide, europium oxide, gandolinium oxide, terbium oxide, dysprosium oxide, holmium oxide, erbium oxide, thulium oxide, ytterbium oxide and lutetium oxide, and at least one second metal oxide of aluminum oxide, indium oxide, germanium oxide and gallium oxide.

25. The zinc oxide varistor according to claim 24, wherein said at least one second metal oxide is present in said mixture in an amount of $1.0\times10^{-4}$–1.0% by weight of said mixture.

26. The zinc oxide varistor according to claim 24, with the proviso that if the at least one metal oxide comprises at least one member of the group consisting of cobalt oxide and manganese oxide, the glass particulate material and the at least one metal oxide are mixed to form said mixture and, upon forming, said mixture contains 5–30% by weight of boron oxide, 5–30% by weight of silicon oxide, 40.0–80% by weight of lead oxide, and 0.1–30.0% by weight of said at least one metal oxide.

27. The zinc oxide varistor according to claim 24, wherein the lead borosilicate-type glass particulate material and the at least one metal oxide are mixed to form said mixture, and then the mixture is fused and thereafter quenched, said mixture, upon forming, contains 5.0–30% by weight of boron oxide, 5.0–30% by weight of silicon oxide, 40.0–80% by weight of lead oxide and 0.1%–30.0% by weight of said at least one metal oxide.

28. The zinc oxide varistor according to claim 27, wherein the mixture contains 0.1–30.0% by weight cobalt oxide.

29. The zinc oxide varistor according to claim 27, wherein the mixture contains 0.1–30.0% by weight magnesium oxide.

30. The zinc oxide varistor according to claim 27, wherein the mixture contains 0.1–30.0% by weight yttrium oxide.

31. The zinc oxide varistor according to claim 27, wherein the mixture contains 0.1–30.0% by weight antimony oxide.

32. The zinc oxide varistor according to claim 27, wherein the mixture contains 0.1–30.0% by weight manganese oxide.

33. The zinc oxide varistor according to claim 27, wherein the mixture contains 0.1–30.0% by weight tellurium oxide.

34. The zinc oxide varistor according to claim 27, wherein the mixture contains 0.1–30.0% by weight lanthanum oxide.

35. The zinc oxide varistor according to claim 27, wherein the mixture contains 0.1–30.0% by weight cerium oxide.

36. The zinc oxide varistor according to claim 27, wherein the mixture contains 0.1–30.0% by weight praseodymium oxide.

37. The zinc oxide varistor according to claim 27, wherein the mixture contains 0.1–30.0% by weight neodymium oxide.

38. The zinc oxide varistor according to claim 27, wherein the mixture contains 0.1–30.0% by weight samarium oxide.

39. The zinc oxide varistor according to claim 27, wherein the mixture contains 0.1–30.0% by weight europium oxide.

40. The zinc oxide varistor according to claim 27, wherein the mixture contains 0.1–30.0% by weight gadolinium oxide.

41. The zinc oxide varistor according to claim 27, wherein the mixture contains 0.1–30.0% by weight terbium oxide.

42. The zinc oxide varistor according to claim 27, wherein the mixture contains 0.1–30.0% by weight dysprosium oxide.

43. The zinc oxide varistor according to claim 27, wherein the mixture contains 0.1–30.0% by weight holmium oxide.

44. The zinc oxide varistor according to claim 27, wherein the mixture contains 0.1–30.0% by weight erbium oxide.

45. The zinc oxide varistor according to claim 27, wherein the mixture contains 0.1–30.0% by weight thulium oxide.

46. The zinc oxide varistor according to claim 27, wherein the mixture contains 0.1–30.0% by weight ytterbium oxide.

47. The zinc oxide varistor according to claim 27, wherein the mixture contains 0.1–30.0% by weight lutetium oxide.

48. A process for producing a zinc oxide varistor characterized by diffusing a lead borosilicate-type glass into a surface of a fired varistor element, and providing said varistor element with at least two electrodes, said lead borosilicate-type glass comprising a mixture of lead borosilicate-type glass particulate material and at least one metal oxide selected from the group consisting of cobalt oxide, magnesium oxide, yttrium oxide, antimony oxide, manganese oxide, tellurium oxide, lanthanum oxide, cerium oxide, praseodium oxide, neodymium oxide, samarium oxide, europium oxide, gadolinium oxide, terbium oxide, dysprosium oxide, holmium oxide, erbium oxide, thulium oxide, ytterbium oxide and lutetium oxide, wherein the glass particulate material and the at least one metal oxide are mixed to form said mixture and then said mixture is fused and thereafter quenched, with the provisos that if the glass comprises at least one member of the group consisting of cobalt oxide and manganese oxide, then upon mixing the glass particulate material and the at least one metal oxide to form said mixture, said mixture contains 5.0–30% by weight of boron oxide, 5.0–30% by weight of silicon oxide, 40.0–80% by weight of lead oxide, and 0.1%–30.0% by weight of said at least one metal oxide.

49. The process for producing a zinc oxide varistor according to claim 48, wherein the lead borosilicate-type glass particulate material and the at least one metal oxide are mixed to form said mixture, and then the mixture is fused and thereafter quenched, said mixture, upon forming, contains 5.0–30% by weight of boron oxide, 5.0–30% by weight of silicon oxide, 40.0–80% by weight of lead oxide and 0.1%–30.0% by weight of said at least one metal oxide.

50. A process for producing a zinc oxide varistor comprising diffusing a lead borosilicate-type glass into a surface of a fired varistor element, and providing said varistor element with at least two electrodes, said lead borosilicate-type glass comprising a mixture of lead borosilicate-type glass particulate material and at least one metal oxide selected from the group consisting of cobalt oxide, magnesium oxide, yttrium oxide, antimony oxide, manganese oxide, tellurium oxide, lanthanum oxide, cerium oxide, praseodium oxide, neodymium oxide, samarium oxide, europium oxide, gadolinium oxide, terbium oxide, dysprosium oxide, holmium oxide, erbium oxide, thulium oxide, ytterbium oxide and lutetium oxide, which is characterized by applying said lead borosilicate-type glass onto said surface of said fired varistor element, and then heating it, thereby having said lead borosilicate-type glass diffuse from said surface of the fired varistor element into the fired varistor element.

51. The process according to claim 50, with the proviso that if the at least one metal oxide comprises at least one member of the group consisting of cobalt oxide and manganese oxide, the glass particulate material and the at least one metal oxide are mixed to form said mixture and, upon forming, said mixture contains 5–30% by weight of boron oxide, 5–30% by weight of silicon oxide, 40.0–80% by weight of lead oxide, and 0.1–30.0% by weight of said at least one metal oxide.

52. A process for producing a zinc oxide varistor comprising diffusing a lead borosilicate-type glass into a surface of a fired varistor element, and providing said fired varistor element with at least two electrodes, said lead borosilicate-type glass comprising a mixture of lead borosilicate-type glass particulate material at least one metal oxide selected from the group consisting of cobalt oxide, magnesium oxide, yttrium oxide, antimony oxide, manganese oxide, tellurium oxide, lanthanum oxide, cerium oxide, praseodium oxide, neodymium oxide, samarium oxide, europium oxide, gadolinium oxide, terbium oxide, dysprosium oxide, holmium oxide, erbium oxide, thulium oxide, ytterbium oxide and lutetium oxide, and at least one member of the group consisting of aluminum, indium, gallium and germanium.

53. The process according to claim 52, with the proviso that if the at least one metal oxide comprises at least one member of the group consisting of cobalt oxide and manganese oxide, the glass particulate material and the at least one metal oxide are mixed to form said mixture and, upon forming, said mixture contains 5–30% by weight of boron oxide, 5–30% by weight of silicon oxide, 40.0–80% by weight of lead oxide, and 0.1–30.0% by weight of said at least one metal oxide.

54. A process for producing a zinc oxide varistor comprising diffusing a lead borosilicate-type glass into a surface of a fired varistor element, and providing said fired varistor element with at least two electrodes, said lead borosilicate-type glass comprising a mixture of lead borosilicate-type glass,particulate material at least one metal oxide selected from the group consisting of cobalt oxide, magnesium oxide, yttrium oxide, antimony oxide, manganese oxide, tellurium oxide, lanthanum oxide, cerium oxide, praseodium oxide, neodymium oxide, samarium oxide, europium oxide, gadolinium oxide, terbium oxide, dysprosium oxide, holmium oxide, erbium oxide, thulium oxide, ytterbium oxide and lutetium oxide, and at least one member of the group consisting of aluminum oxide, indium oxide, gallium oxide and germanium oxide.

55. A process for producing a zinc oxide varistor comprising diffusing a lead borosilicate-type glass into a surface of a fired varistor element, and providing said fired varistor element with at least two electrodes, said lead borosilicate-type glass comprising a mixture of lead borosilicate-type glass particulate material and at least one metal oxide selected from the group consisting of cobalt oxide, magnesium oxide, yttrium oxide, antimony oxide, manganese oxide, tellurium oxide, lanthanum oxide, cerium oxide, praseodium oxide, neodymium oxide, samarium oxide, europium oxide, gadolinium oxide, terbium oxide, dysprosium oxide, holmium oxide, erbium oxide, thulium oxide, ytterbium oxide and lutetium oxide, which is characterized by applying said lead borosilicate-type glass onto a surface of said varistor, and then adding at least one of aluminum, indium, gallium and germanium onto a surface of said lead borosilicate-type glass.

56. A process for producing a zinc oxide varistor comprising diffusing a lead borosilicate-type glass into a surface of a fired varistor element, and providing said fired varistor element with at least two electrodes, said lead borosilicate-type glass comprising a mixture of lead borosilicate-type glass particulate material and at least one metal oxide selected from the group consisting of cobalt oxide, magnesium oxide, yttrium oxide, antimony oxide, manganese oxide, tellurium oxide, lanthanum oxide, cerium oxide, praseodium oxide, neodymium oxide, samarium oxide, europium oxide, gadolinium oxide, terbium oxide, dysprosium oxide, holmium oxide, erbium oxide, thulium oxide, ytterbium oxide and lutetium oxide, which is characterized by applying said lead borosilicate-type glass onto a surface of said varistor element, and then adding at least one of aluminum oxide, indium oxide, gallium oxide and germanium oxide onto a surface of said lead borosilicate-type glass.

57. A process for producing a zinc oxide varistor comprising adding a lead borosilicate-type glass to an electrode paste, and then applying the resulting electrode paste onto a surface of a fired varistor element, which is followed by baking the fired varistor element to form an electrode from the electrode paste, said lead borosilicate-type glass comprising a mixture of lead borosilicate-type glass particulate material and at least one metal oxide selected from the group consisting of cobalt oxide, magnesium oxide, yttrium oxide, antimony oxide, manganese oxide, tellurium oxide, lanthanum oxide, cerium oxide, praseodium oxide, neodymium oxide, samarium oxide, europium oxide, gadolinium oxide, terbium oxide, dysprosium oxide, holmium oxide, erbium oxide, thulium oxide, ytterbium oxide and lutetium oxide, said borosilicate-type glass being diffused from the electrode paste to inside the fired varistor element.

58. The process for producing a zinc oxide varistor according to claim 57, further comprising adding at least one chemical element of aluminium, indium, gallium and germanium, into the electrode paste which contains a lead borosilicate-type glass.

59. The process for producing a zinc oxide varistor according to claim 57, further comprising adding at least one of aluminium oxide, indium oxide, gallium oxide and germanium oxide into the electrode paste.

60. The process according to claim 57, with the proviso that if the at least one metal oxide comprises at least one member of the group consisting of cobalt oxide and manganese oxide, the glass particulate material and the at least one metal oxide are mixed to form said mixture and, upon forming, said mixture contains 5–30% by weight of boron oxide, 5–30% by weight of silicon oxide, 40.0–80% by weight of lead oxide, and 0.1–30.0% by weight of said at least one metal oxide.

61. A process for producing a zinc oxide varistor comprising diffusing a lead borosilicate-type glass into a surface of a fired varistor element, and providing said varistor element with at least two electrodes, said lead borosilicate-type glass comprising a mixture of lead borosilicate-type particulate material and at least one metal oxide selected from the group consisting of magnesium oxide, yttrium oxide, antimony oxide, tellurium oxide, lanthanum oxide, cerium oxide, praseodium oxide, neodymium oxide, samarium oxide, europium oxide, gadolinium oxide, terbium oxide, dysprosium oxide, holmium oxide, erbium oxide, thulium oxide, ytterbium oxide and lutetium oxide, said borosilicate-type glass being diffused from the surface of the fired varistor element to inside the fired varistor element.

62. The process according to claim 61, wherein the glass particulate material and the at least one metal oxide are mixed to form said mixture and, upon forming, said mixture contains 5–30% by weight of boron oxide, 5–30% by weight of silicon oxide, 40.0–80% by weight of lead oxide, and 0.1–30.0% by weight of said at least one metal oxide.

63. A zinc oxide varistor comprising a fired varistor element having opposite surfaces and at least two electrodes formed on said fired varistor element from an electrode paste, said fired varistor element comprising a lead borosilicate-type glass diffused into at least one surface of said fired varistor element dining a heating operation employed to form said electrodes; said lead borosilicate-type glass comprising a mixture of lead borosilicate-type glass particulate material and at least one metal oxide selected from the group consisting of magnesium oxide, yttrium oxide, antimony oxide,, tellurium oxide, lanthanum oxide, cerium oxide, praseodium oxide, neodymium oxide, samarium oxide, europium oxide, gadolinium oxide, terbium oxide, dysprosium oxide, holmium oxide, erbium oxide, thulium oxide, ytterbium oxide and lutetium oxide, said lead borosilicate-type glass being diffused from the surface of the fired varistor element to inside the fired varistor element.

64. The zinc oxide varistor according to claim 61, wherein the glass particulate material and the at least one metal oxide are mixed to form said mixture and, upon forming, said mixture contains 5–30% by weight of boron oxide, 5–30% by weight of silicon oxide, 40.0–80% by weight of lead oxide, and 0.1–30.0% by weight of said at least one metal oxide.

* * * * *